US006267027B1

(12) United States Patent
Mitchell

(10) Patent No.: US 6,267,027 B1
(45) Date of Patent: Jul. 31, 2001

(54) ANALOG POSITION RATCHET MECHANISM

(76) Inventor: M. Todd Mitchell, 1154 N. 2925 West, Layton, UT (US) 84041

( * ) Notice: Subject to any disclaimer, the term of this patent is extended or adjusted under 35 U.S.C. 154(b) by 0 days.

This patent is subject to a terminal disclaimer.

(21) Appl. No.: 09/533,890

(22) Filed: Mar. 22, 2000

Related U.S. Application Data

(63) Continuation-in-part of application No. 09/065,806, filed on Apr. 23, 1998, now Pat. No. 6,055,888.

(51) Int. Cl.[7] ..... B25B 13/00
(52) U.S. Cl. ..... 81/59.1; 81/63.1; 81/59.39
(58) Field of Search ..... 81/59.1, 58; 192/44

(56) References Cited

U.S. PATENT DOCUMENTS

| | | | | |
|---|---|---|---|---|
| 2,989,160 | | 6/1961 | Woodruff . | |
| 3,590,667 | | 7/1971 | Berglein . | |
| 3,621,739 | | 11/1971 | Seablom . | |
| 3,679,031 | | 7/1972 | Stephens . | |
| 3,752,277 | * | 8/1973 | Nakai | 192/44 |
| 4,429,598 | | 2/1984 | Tucker . | |
| 4,485,700 | | 12/1984 | Colvin . | |
| 4,520,697 | | 6/1985 | Moetteli . | |
| 4,631,988 | | 12/1986 | Colvin . | |
| 4,903,554 | | 2/1990 | Colvin . | |
| 4,987,803 | | 1/1991 | Chern . | |
| 5,165,509 | * | 11/1992 | Kanno et al. | 192/44 |
| 5,178,047 | | 1/1993 | Arnold et al. . | |
| 5,235,878 | | 8/1993 | Young . | |
| 5,582,080 | | 12/1996 | Barmore . | |
| 5,596,913 | | 1/1997 | Matsubara et al. . | |
| 5,630,342 | | 5/1997 | Owoc . | |
| 5,697,267 | | 12/1997 | Tsai . | |
| 5,709,137 | | 1/1998 | Blacklock . | |
| 6,055,888 | * | 5/2000 | Mitchell | 81/59.1 |

* cited by examiner

*Primary Examiner*—James G. Smith
*Assistant Examiner*—Lee Wilson
(74) *Attorney, Agent, or Firm*—Thorpe North & Western, L.L.P.

(57) ABSTRACT

A wrench device has a bearing-type clutch for providing a unidirectional rotational force and an opposite unidirectional independent rotation. The wrench device includes a set of larger and smaller bearings disposed in an irregular space with larger and smaller tapering sections between a primary wall of a primary body and a secondary wall of a secondary body. The space has tapering or narrowing sections in which the bearings bind to fixedly engage the primary and secondary bodies as the primary body rotates in a first rotational direction. A pin or toggle dislodges the bearings so that the primary body may rotate freely in a second, opposing rotational direction while another bearing binds the secondary body to the primary body when the primary body is rotated in the first rotational direction. Alternatively, the bearings are selectively positioned in the space to cause the primary and secondary to rotate together or independently depending on the positioning of the bearing and the rotational direction of the primary body. The bearings may be non-circular, and have protrusions pivoting in indentations in either the primary or secondary walls.

29 Claims, 20 Drawing Sheets

ANALOG POSITION RATCHET MECHANISM

This application is a continuation-in-part of U.S. patent application Ser. No. 09/065,806, filed Apr. 23, 1998 now U.S. Pat. No. 6,055,888.

BACKGROUND OF THE INVENTION

1. The Field of the Invention

The present invention relates generally to an instant engagement, bearing-type clutch, particularly well suited for use with a wrench.

2. The Background Art

Various types of fasteners are used to attach two or more members together. A bolt and nut combination is one type of well known fastener. The bolt includes a male threaded end configured to engage a female threaded nut.

The driving end of the bolt, or the head, and the nut are provided with bodies of standard size and shape. The most common shape is a hexagon, or six-sided body. Other shapes are available, including a square. The head may also be provided with a hole or bore of standard size and shape. Such shapes include various stars with straight and curved sides and various polygons. In addition, such heads and nuts are provided in English and metric size ranges, such as ⅛ in., 3⁄16 in., ¼ in., 5⁄16 in., ⅜ in., etc., or 3 mm, 4 mm, 5 mm, 6 mm, etc.

Special tools are configured to engage and drive either the head of the bolt and/or the nut. For example, a wrench typically has an open-ended jaw and a closed-ended jaw. The ends are sized and configured to mate with the bolt head or nut. Thus, wrenches typically have apertures formed in the ends with various polygonal shapes, or stars with various numbers of points. In addition, the wrenches are usually provided in sets having numerous wrenches each having jaws configured to mate with a particularly sized bolt head or nut. By engaging the bolt head or nut with the appropriate wrench, the bolt or nut may be rotated clockwise or counterclockwise in order to tighten or loosen the fastener, respectively.

One problem with the above described wrenches is that they often must be continually disengaged and re-engaged with the nut or bolt. Often, a fastener is placed adjacent another member or located in a limited space. Because the wrench has an elongated body, it may be turned only a fraction of the necessary rotation before any further rotation is impeded. Thus, the wrench must be disengaged from the head, rotated back to the starting point, re-engaged with the head, rotated until again impeded, and the process repeated until the fastener is either loosened or tightened. In addition, if the head is located where only a small rotation is possible, the wrench must also be turned over after disengaging because the handle extends at an angle from the end of the wrench. Furthermore, if the space is extremely tight, the wrench may be rendered useless because there is insufficient space in which the wrench may turn the head.

A ratchet wrench is very popular and solves many of the above identified problems with the standard wrench. The ratchet wrench has a ratchet mechanism which allows a handle of the wrench to rotate freely in one direction, but engage a driver coupled to a head of the ratchet wrench in the opposite direction. This allows the ratchet wrench to engage a head, and rotate back and forth, tightening or loosening the fastener without having to disengage the wrench from the head. The typical ratchet wrench has an elongated body with a head adapted to receive sockets of various sizes and shapes. Thus, sockets usually are provided in sets with one or more ratchet wrenches. The ratchet wrench typically has a set of teeth formed on a driver portion and a pawl which engage in one direction.

One problem with the ratchet wrench is the finite increments the wrench may be rotated backwards. Conventional ratchet wrenches have a finite number of engagement points and are therefore limited in the degree they may be rotated backwards by the number of the teeth. For example, if there are 60 teeth, the ratchet wrench is limited to 6 degree increments when rotating backwards before another tooth can be engaged. If the head of the bolt is located in a tight space, it may not be possible to rotate the ratchet wrench a full 6 degrees. Thus, the wrench will not be able to rotate back more than the 6 degrees to engage the next tooth, rendering the wrench useless.

SUMMARY OF THE INVENTION

It has been recognized that it would be advantageous to develop a wrench with an infinite number of engagement points, or a wrench that instantly engages despite the amount of backwards rotation. It also has been recognized that it would be advantageous to develop such a wrench capable of operation in both directions, or a reversible wrench. It also has been recognized that it would be advantageous to develop a reversible clutch capable of instantaneous engagement and with infinite increments in the reverse direction.

The invention provides a wrench device having a bearing clutch device. The device includes a primary body with a primary wall, and a secondary body movably coupled to the primary body, with a secondary wall generally opposing the primary wall. A first tapering space is formed between the primary and secondary bodies, or primary and secondary walls, which advantageously includes larger and smaller tapering sections.

A first set of bearings is disposed in the first tapering space, which advantageously includes larger and smaller bearings movably disposed in the respective larger and smaller tapering sections. The bearings are movable between a free location, and a binding location, in which the larger and smaller bearings advantageously form two points of engagement between the primary and secondary bodies at the tapering space.

The larger and smaller bearings (i) fixedly engage the primary and secondary bodies in a first fixed relationship with the primary body in a first relative position, responsive to rotational movement of the primary body in a first rotational direction, (ii) disengage the primary and secondary bodies, responsive to an amount of rotational movement of the primary body in a second rotational direction, and (iii) fixedly re-engage the primary and secondary bodies in a second fixed relationship with the primary body in a second relative position, responsive to rotational movement of the primary body in the first rotational direction and regardless of the amount of rotational movement of the primary body in the second rotational direction.

In accordance with another aspect of the present invention, the device may include displacement means for displacing the larger and smaller bearings from the binding location to the free location. The displacement means may include a pivot member pivotally coupled to the primary body, and at least one member connected to the pivot member and extending into the tapering space. Pivoting the pivot member in a first pivot direction causes the member to contact and dislodge the larger and smaller bearings. The member may include a swivel link and a pusher member pivotally disposed on the end of the swivel link.

In accordance with another aspect of the present invention, the device may include biasing means disposed between the primary and secondary bodies for biasing the larger and smaller bearings towards the respective larger and smaller tapering spaces, and thus towards the binding location.

In accordance with another aspect of the present invention, the bearing clutch device may be bi-directional. The device may include at least first and second tapering spaces tapering in opposite directions, and each having at least two different size tapering sections, including a larger tapering section and a smaller tapering section.

At least first and second sets of bearings are each movably disposed in one of the at least two tapering spaces. Each bearing set includes a larger bearing and a smaller bearing movably disposed in the respective larger and smaller tapering sections.

The displacement means may selectively displace one of the first and second sets of bearings from the binding location to the free location, to prevent the displaced set of bearings from binding. Thus, displacement of the first set of bearings from the first tapering space allows the primary body to rotate independently with respect to the secondary body in a second rotational direction. In addition, displacement of the second set of bearings from the second tapering space allows the primary body to rotate independently with respect to the secondary body in a first rotational direction.

The at least two tapering spaces may taper towards one another with the displacement means disposed between the at least two tapering spaces. Alternatively, the at least two tapering spaces may taper away from one another with the displacement means disposed on both sides of the at least two tapering spaces.

In accordance with another aspect of the present invention, the bearings may be non-circular. The bearings may have protrusions, pivotally disposed in indentations formed in either one of the primary or secondary walls.

In accordance with another aspect of the present invention, a third bearing, smaller than the larger and smaller bearings, may be disposed between the larger and smaller bearings.

In accordance with another aspect of the present invention, the tapering space may include a larger tapering space and two smaller tapering spaces on either side of the larger tapering space. The larger and smaller bearings may include a single larger bearing disposed in the larger tapering space, and two smaller bearings disposed in either of the smaller tapering spaces.

In accordance with another aspect of the present invention, at least one non-circular bearing is movably disposed in a space between the primary and secondary bodies. The bearing may have a protrusion pivotally disposed in an indentation formed in either one of the primary or secondary bodies, and being pivotable about the protrusion.

Additional features and advantages of the invention will be set forth in the detailed description which follows, taken in conjunction with the accompanying drawing, which together illustrate by way of example, the features of the invention.

BRIEF DESCRIPTION OF THE DRAWINGS

FIG. 19*b* is a top, break-away view of the wrench device of FIG. 19*a*, shown in a second position;

DETAILED DESCRIPTION

Figure 1:
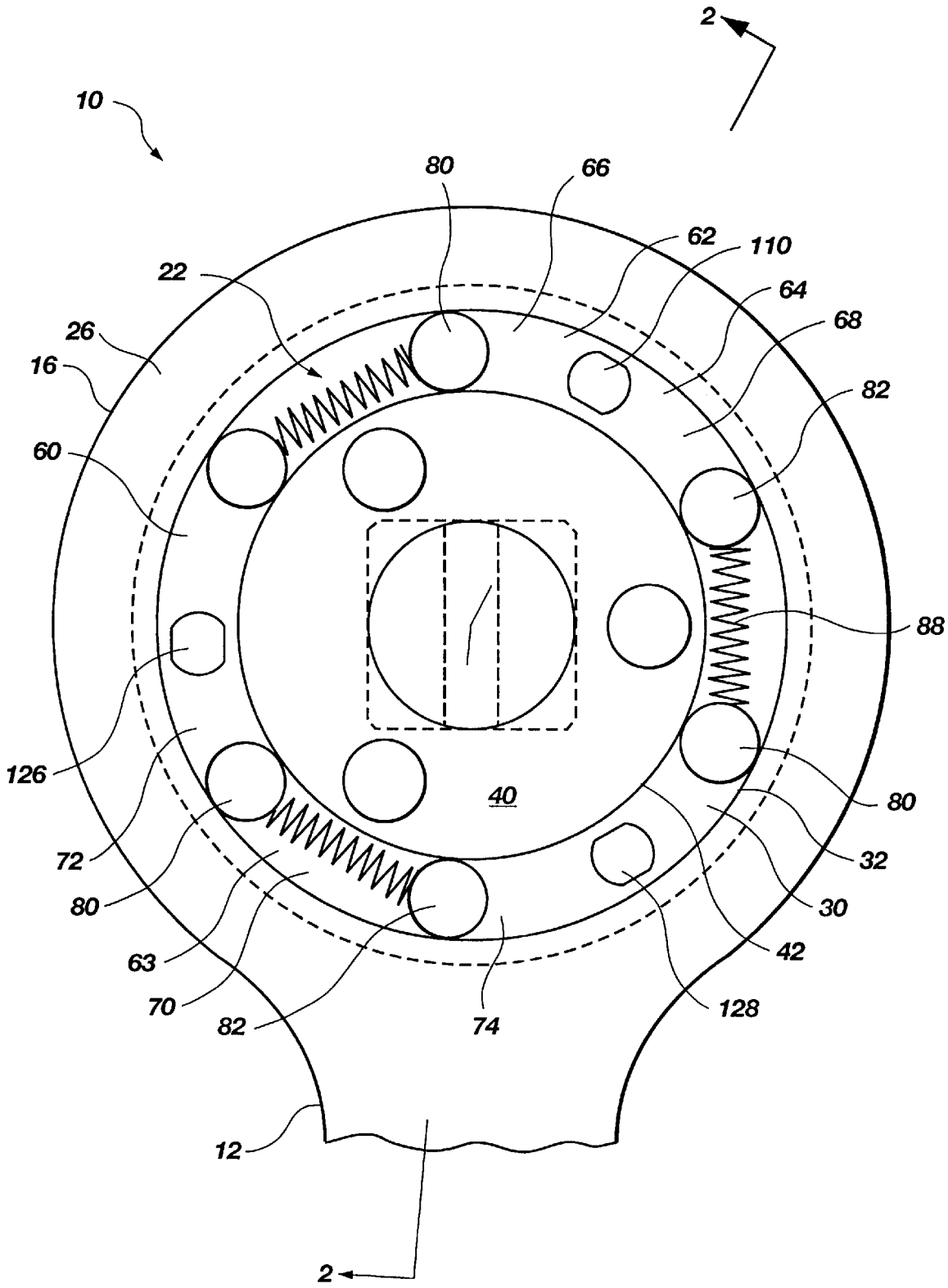
FIG. 1 is a top, break-away view of a wrench device made in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
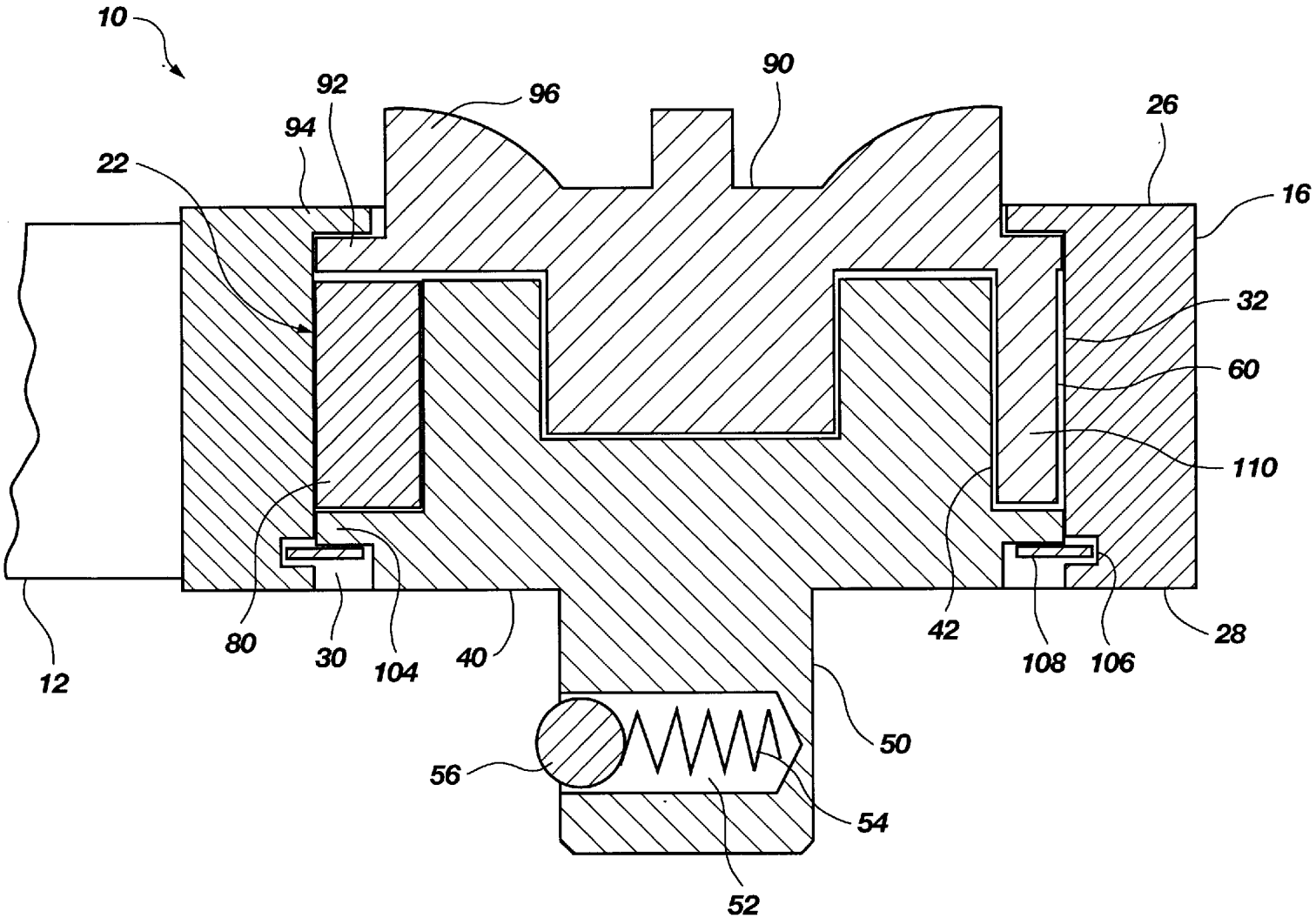
FIG. 2 is a side, cross-sectional view of the wrench device of FIG. 1, taken along section 2—2.
Figure 7:
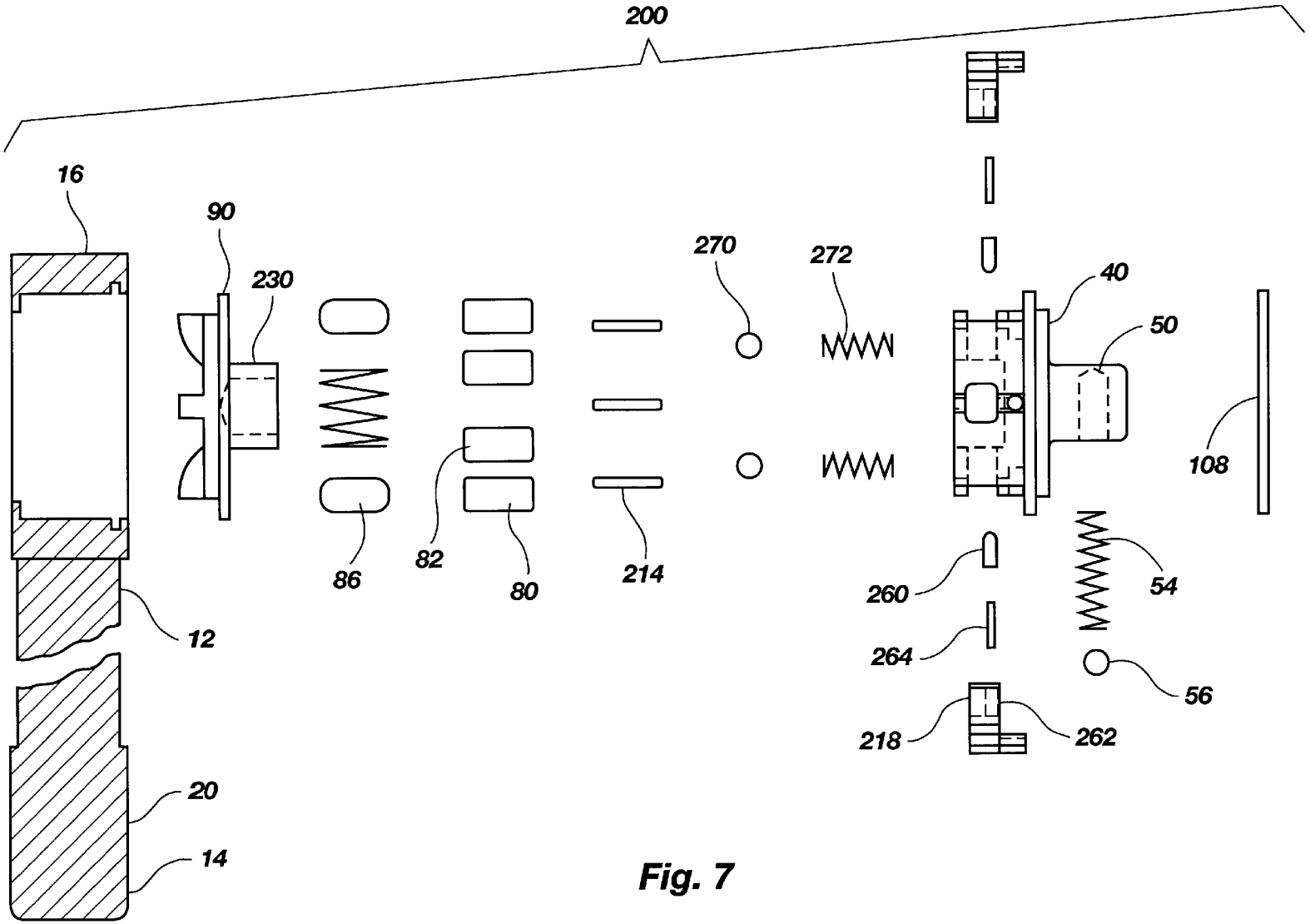
FIG. 7 is an exploded view of the wrench device of FIG. 4.

Referring to FIGS. 1 and 2, a wrench device, indicated generally at 10, of the present invention is shown. The wrench device 10 has an elongated main or primary body 12 with proximal and distal ends 14 and 16, as shown in FIG. 7. A handle 20 is formed on the proximal end 14 of the main body 12 for a user to grasp, again as shown in FIG. 7. The distal end 16 defines a head for engaging and driving a socket or a fastener. Although only the head portion 16 of the wrench device 10 is shown in many of the drawings, the elongated body and handle portion of the wrench device are well known in the art for providing leverage and grip. The wrench device 10 has a reversible, bearing-type clutch, indicated generally at 22, for reversibly and selectively providing a rotational force in one direction and free or independent rotational movement in the other direction.

The wrench device 10 may drive or loosen a fastener (not shown). As used herein, the term "fastener" is used broadly to indicate any type of device for fastening, particularly a type requiring rotational motion to operate. Specifically, the term "fastener" includes at least a bolt or a nut. Typically, nuts and bolts are characterized by hexagonally shaped bodies or heads. Alternatively, other shaped bodies are also included in the term "fastener." In addition, variously shaped indentations or cavities may be formed in the bodies. To accommodate these various types of fasteners, corresponding or mating "sockets" have been developed to engage the fasteners. The term "socket" is also used broadly herein to indicate any device which engages a "fastener." Fasteners and sockets are well known in the art. Thus, the head portion 16 of the wrench device 10 engages and drives the fastener and socket (not shown).

The head 16 or primary body 12 has an upper side 26 and a lower side 28, as shown in FIG. 2. A cavity 30 is formed in the head 16 of the primary body 12 which may extend through the head 16 from the upper side 26 to the lower side 28, as shown in FIG. 2. Thus, the cavity 30 is formed traverse to the longitude of the body 12 and the upper and lower sides 26 and 28.

The cavity 30 or primary body 12 has a cavity or primary wall 32 which is preferably formed by the circumference of the cavity 30. The cavity 30 and cavity wall 32 are circular or cylindrical, but may be another shape as discussed more fully below. In addition, the cavity 30 may have sections of various diameters, or annular indentations and annular projections or flanges, as discussed more fully below.

The wrench device 10 also has an engagement cam or secondary body 40 rotatably coupled to the primary body 12. The secondary body 40 is disposed in the cavity 30 of the primary body 12. The cam or secondary body 40 has a cam or secondary wall 42, or drive wall. The secondary wall 42 and the primary wall 32 face each other, or are generally opposing one another. The secondary body 40 and secondary wall 42 may be circular or cylindrical, but may be another shape as discussed more fully below. In addition, the secondary body 40 may have sections of various diameters, or annular indentations and annular projections or flanges, as discussed more fully below.

Referring to FIG. 2, a drive member 50 is disposed on the secondary body 40 for engaging and driving a socket (not shown). The drive member 50 and secondary body 40 may be integrally formed. The drive member 50 is sized and configured to engage a cavity of a socket. The drive member 50 may be a protrusion with a standard size and shape configured for engaging a cavity of a standard size and shape in the socket. Thus, the drive member 50 typically will be a protrusion with a square cross section sized for standard socket cavities.

The drive member 50 also has a drive cavity 52 for receiving a drive detent ball 56 and drive spring 54, as is well known in the art. As the drive member 50 is inserted into the cavity of the socket, the detent ball 56 is pressed into the drive cavity 52. When the drive member 50 is fully inserted into the cavity of the socket, the spring 54 forces the detent ball 56 to protrude from the drive cavity 52 and into an indentation formed in the cavity of the socket to retain the socket on the drive member 50.

The drive member 50, or the drive member 50 and secondary body 40, is one example of a driving means for coupling to and driving a fastener or socket. It is of course understood that other drive means for coupling to and driving fasteners and/or sockets are available and include, for example, an integral cam and drive member, a drive member and socket, and integral drive member and socket, etc.

Referring again to FIG. 1, a space 60 is formed between the secondary wall 42 and the primary wall 32, or between the primary body 12 and the secondary body 40. The space 60 advantageously has a nonuniform or uneven width, or tapers, the purpose of which is discussed more fully below. The shape or width of the space 60 is determined by the shape of the cavity 30 and the shape of the secondary body 40. As indicated above, the primary wall 32 may be circular while the secondary wall 42 is non-circular, thus forming a nonuniform space 60. Alternatively, the primary wall 32 may be non-circular while the secondary wall 42 is circular. In addition, both the primary wall 32 and the secondary wall 42 may be non-circular, or uneven.

The variation in the wall 32 and 42 or body 12 and 40 shapes is to create a nonuniform space 60 therebetween, or a space 60 with varying distances between the opposing walls 32 and 42, or a space 60 with walls 32 and 42 that taper towards and/or away from one another. The tapering walls create one or more narrowing sections within the space 60. The non-circular walls may be formed of various arcs or straight lines. The nonuniform space 60 is configured and dimensioned to cause the primary body 12 to rotate independently with respect to the secondary body 40 in one rotational direction, and to cause the primary body and secondary body 40 to engage and rotate together in another rotational direction, as discussed more fully below.

The space 60 may be annular or ring-like, with one or more narrowing sections. Conceptually, the space 60 may be viewed as being comprised of several, arc-like, component spaces 62 and 63, each having opposing narrowing ends or sections, disposed end-to-end to form a larger annular space. As shown, the space 60 is formed of three, arc-like spaces. The narrowing ends or sections narrow in opposing directions and may narrow towards the component space or away from the component space. The component spaces 62 may have a narrow center section 64 and narrowing ends 66 and 68 that narrow towards the center section 64, or widen away from the center section. The space 62 has a first narrowing section 66 defining a forward end or section and a second narrowing section 68 defining a reverse end or section.

Alternatively, the component spaces 63 may have a wider center section 70 and narrowing ends 72 and 74 that narrow away from the center section 70, or widen towards the center section. The space 63 has a first narrowing section 72 defining a forward end or section and a second narrowing section 74 defining a reverse end or section. It will be appreciated that when the component spaces 62 or 63 are arranged annularly, the component spaces 62 or 63 may be conceptually viewed as either wide spaces with narrow ends or narrow spaces with wide ends, as described above. However, if only a single component space 62 or 63 is used, either type of space 62 or 63 may be used.

At least two engagement bearings 80 and 82, or a pair of bearings, are disposed in the space 60 between the primary wall 32 and the secondary wall 42. The bearings are positioned and dimensioned to bind in the narrowing ends 66 and 68 or 72 and 74 to engage the primary body 12 with the secondary body 40. A first bearing 80 defines a forward bearing and is disposed closer to the first, or forward, narrowing end 66 or 72 than the reverse section. A second bearing 82 defines a reverse bearing and is disposed near the second, or reverse, narrowing end 68 or 74 than the forward end.

Figure 3B:
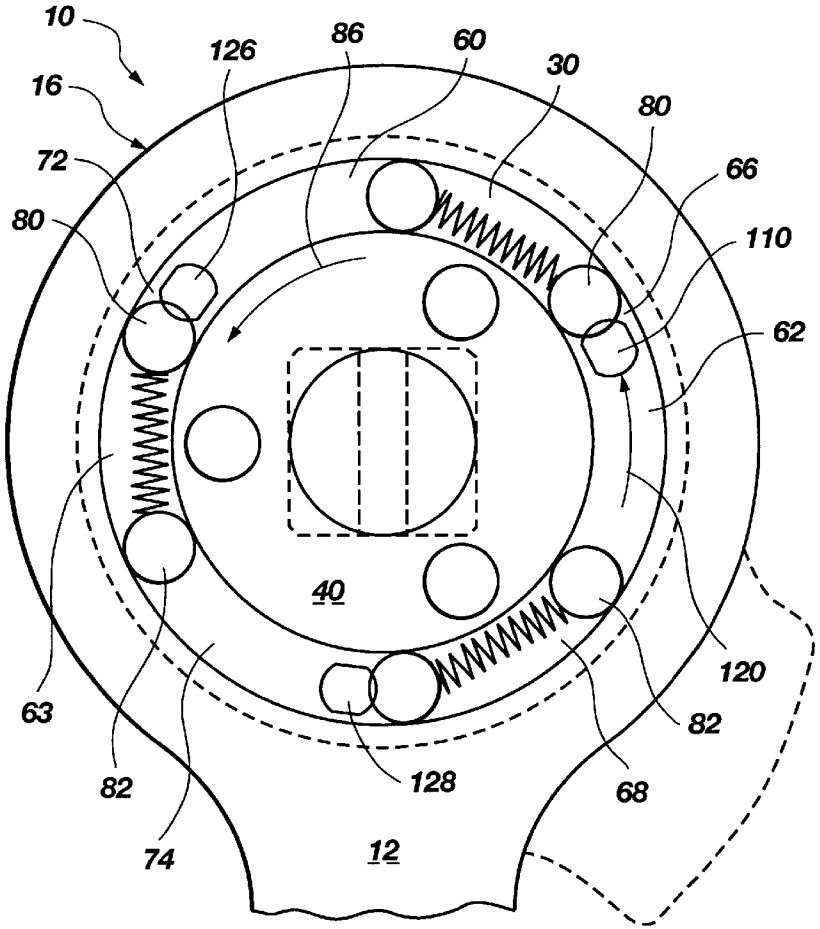
FIG. 3B is a top, break-away view of the wrench device of FIG. 1, in a second position.
Figure 3A:
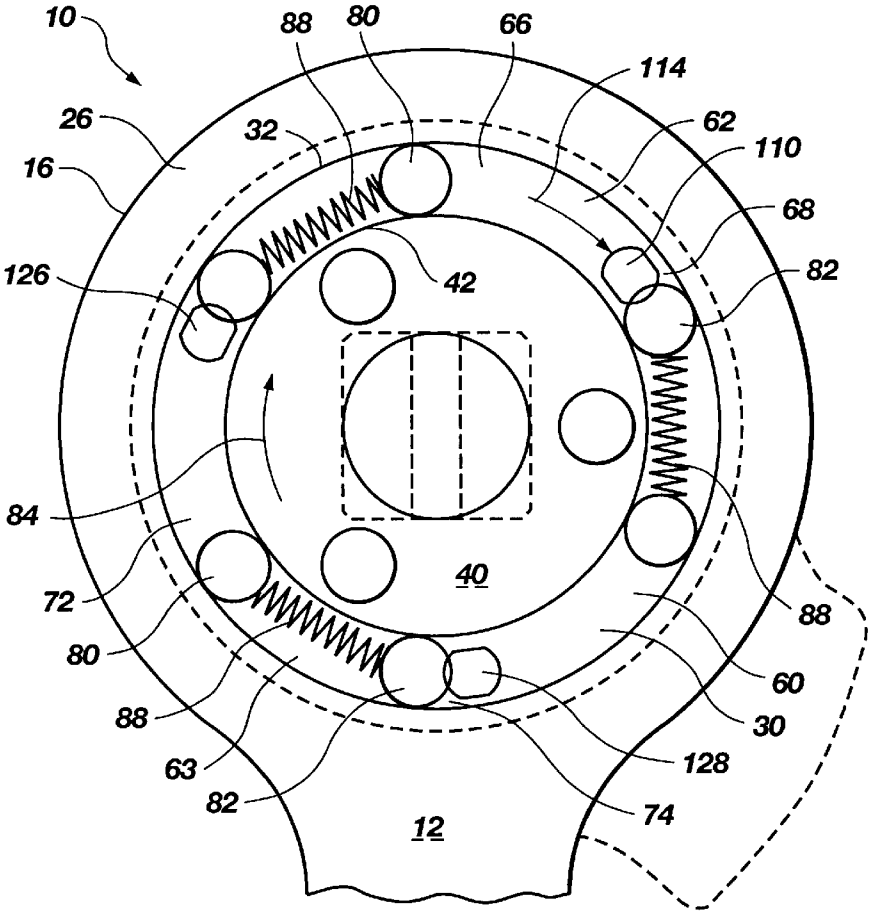
FIG. 3A is a top, break-away view of the wrench device of FIG. 1, in a first position.

Referring to FIG. 3A, the forward bearing 80 binds between the primary wall 32 and the secondary wall 42 as the primary body 12 rotates with respect to the secondary body 40 in a first rotational direction, or in a forward rotational direction, indicated by the arrow 83. The forward bearing 80 causes the secondary body 40, and thus the drive member 50, to engage and rotate with the primary body 12, as indicated by arrow 84.

Referring to FIG. 3B, the reverse bearing 82 binds between the primary wall 32 and the secondary wall 42 as the primary body 12 rotates with respect to the secondary body 40 in a second rotational direction, or in a reverse rotational direction, indicated by the arrow 85. The reverse bearing 82 causes the secondary body 40, and thus the drive member 50, to engage and rotate with the primary body 12, as indicated by arrow 86.

A spring 88 is disposed in the space 60 for biasing the bearings 80 and 82 towards the narrowing ends or sections 66 and 68 or 72 and 74 of the space 62 or 63. A single spring 88 may be disposed between the bearings 80 and 82 and in the wider center 70 of the space 63. Alternatively, a pair of springs 88 may be disposed on both ends of the bearing pair in the narrow centers 64 of the space 62. The spring is one example of a biasing means for biasing the bearings towards the narrowing ends. It is of course understood that other biasing means are available and include, for example, a rubber member, a pressure differential, etc.

Referring again to FIG. 2, a pivot member 90 is pivotally coupled to the head 16 of the primary body 12. Preferably the pivot member 90 is at least partially disposed in the cavity 30. The pivot member 90 has an annular flange 92 that abuts an annular projection 94 formed on the upper side 26 of the head 16 at the cavity 30 for maintaining the pivot member 90 to the head 16. One or more tabs 96 are formed on the pivot member 90 and project therefrom for a user to grip. The tabs are one example of a grip means for being gripped by a user to pivot the pivot member.

An annular flange 104 is disposed on the secondary body 40. Alternatively, the flange 104 may be a separate component. The flange 104 maintains the bearings 80 and 82 in the cavity 30 of the head 16. An annular indentation 106 is formed in the cavity 30 of the head 16 near the lower side 28. The indentation 106 receives a retaining ring 108 which abuts the flange 104. The retaining ring 108 maintains the secondary body 40, bearings 80 and 82, pivot member 90, and springs 88 within the cavity.

A pin 110, bar or projection, is formed on the pivot member 90 and extends into the cavity 30 of the main body, or into the space 60 between the primary and secondary walls 32 and 42. Referring again to FIG. 1, the pin 110 projects into the space 62 or 63 between the forward and reverse bearings 80 and 82. The pin 110 contacts or engages the bearings 80 and 82 to displace or dislodge the bearings 80 and 82 from the narrowing ends 66 and 68 or 72 and 74. Thus, the pin 110 prevents one of either the forward or reverse bearings 80 and 82 from binding in the narrowing end between the primary body 12 and the secondary body 40.

Referring again to FIG. 3A, the wrench device 10 of FIG. 1 is shown in a configuration for driving, or tightening, a fastener in the clockwise direction. Typically, a right handed thread is used. It is of course understood that if a left handed thread is used then the rotational directions for tightening and loosening must be reversed. As the pivot member 90 (removed in FIG. 3A) pivots in a first pivot direction, indicated by arrow 114, the pin 110 contacts the reverse bearing 82 and dislodges it, or displaces it, from the reverse end 68 of the space 62. Thus, the reverse bearing 82 is prevented from binding by the pin 110.

As the primary body 12 is rotated with respect to the secondary body 40 in the second rotational direction 85, it rotates independently of the secondary body 40, or rotates freely. The spring 88 biases the forward bearing 80 into the forward end 66 of the space 62 and into contact with both the primary and secondary walls 32 and 42. But, the spring 88 allows the forward bearing 80 to move back slightly and slide along the primary and secondary walls 32 and 42 as the primary body 12 rotates with respect to the secondary body 40 in the second rotational direction 85.

As the primary body 12 is rotated with respect to the secondary body 40 in the first rotational direction 83, the forward bearing 80 binds in the forward end 66 of the space 62 between primary and secondary walls 32 and 42. Thus, the primary body 12 and secondary body 40 are engaged and rotate together. As shown in FIG. 3A and described above, such a configuration may be used to impart rotational force and motion to drive, or tighten, a fastener.

Referring now to FIG. 3B, the wrench device 10 of FIG. 1 is shown in a configuration for loosening a fastener in the counter-clockwise direction. As the pivot member 90 (removed in FIG. 3B) pivots in a second pivot direction, indicated by arrow 120, the pin 110 contacts the forward bearing 80 and dislodges it, or displaces it, from the forward end 66 of the space 62. Thus, the forward bearing 80 is prevented from binding by the pin 110.

As the primary body 12 is rotated with respect to the secondary body 40 in the first rotational direction 83, it rotates independently of the engagement cam 40, or rotates freely. The spring 88 biases the reverse bearing 82 into the reverse end 68 of the space 62 and into contact with both the primary and secondary walls 32 and 42. But, the spring 88 allows the reverse bearing 82 to move back slightly and slide along the primary and secondary walls 32 and 42 as the primary body 12 rotates with respect to the secondary body 40 in the first rotational direction 83.

As the primary body 12 is rotated with respect to the secondary body 40 in the second rotational direction 85, the reverse bearing 82 binds in the reverse end 68 of the space 62 between primary and secondary walls 32 and 42. Thus, the primary body 12 and secondary body 40 are engaged and rotate together. As shown in FIG. 3B and described above, such a configuration may be used to impart rotational force and motion to loosen a fastener.

The pivot member 90 and pin 110 are an example of one displacement means for selectively displacing or dislodging one of the bearings 80 or 82 from the narrowing sections or ends 66 or 68 to prevent one of the bearings from binding. Other displacement means are available, some of which are described more fully below.

Referring to FIGS. 3A and 3B, a pair of pins 126 and 128 may be formed on the pivot member (removed in FIGS. 3A and 3B) and extend into the cavity 30 of the primary body 12, or into the space 60 between the primary and secondary walls 32 and 42. A first pin 126 defines a forward pin and projects into the space 63 near the forward end 72. A second pin 128 defines a reverse pin and projects into the space 63 near the reverse end 74. The forward pin 126 contacts or engages the forward bearing 80 to displace or dislodge the bearing 80 from the forward narrowing end 72. Likewise, the reverse pin 128 contacts the reverse bearing 82 to dislodge the bearing 82 from the reverse narrowing end 74. Thus, the pins 126 and 128 each prevent either the forward or reverse bearings 80 and 82, respectively, from binding in the narrowing ends 72 and 74 between the primary body 12 and the secondary body 40.

Referring to FIG. 3A, as the pivot member 90 (removed in FIG. 3A) pivots in the first pivot direction 114 the reverse pin 128 contacts the reverse bearing 82 and dislodges it, or displaces it, from the reverse end 74 of the space 63. Thus, the reverse bearing 82 is prevented from binding by the pin 128. Referring to FIG. 3B, as the pivot member 90 (removed in FIG. 3B) pivots in the second pivot direction 120, the forward pin 126 contacts the forward bearing 80 and dislodges it, or displaces it, from the forward end 72 of the space 63. Thus, the forward bearing 80 is prevented from binding by the pin 126.

It will be appreciated that the operation of the wrench device 10 is similar whether one pin 110 or two pins 126 and 128, or three or more pins, are used. With one pin 110, the pin 110 is disposed between the bearings 80 and 82 while the springs 88 are disposed on either side of the bearing pair. With two pins, the pins 126 and 128 are disposed on either side of the bearing pair while the spring 88 is disposed between the bearings 80 and 82. If multiple bearing pairs are used, the difference is mostly conceptual. The pins may be conceptualized as operating between a pair of bearings or on either side of a bearing pair.

Advantageously, the wrench device 10 has an annular space 60 formed by three component spaces 62 or 63, as indicated above. In addition, the wrench device 10 has three pairs of forward and reverse bearings 80 and 82, with each pair being disposed in a component space 62 or 63. In addition, the wrench device 10 has three springs 88, with each spring 88 being disposed between a pair of bearings 80 and 82. In addition, the wrench device 10 has three pivot pins which act as both forward and reverse pins. Thus, as the pivot member 90 and pins pivot to displace one of the bearings, additional spring force is applied to the other bearing. Furthermore, the secondary body 40 and secondary wall 42 are non-circular, or non-cylindrical, while the cavity 30 and primary wall 32 are circular, or cylindrical.

The engagement bearings 80 and 82 selectively binding between the primary and secondary walls 32 and 42 are one example of an engagement means. The forward bearing 80 responds to a first rotational movement 83 of the primary body 12 to fixedly engage the primary body 12 and the secondary body 40 in a first fixed relationship with the primary body 12 in a first relative position, indicated by the position of the body in solid lines. The forward bearing 80 responds to an amount of a second rotational movement 85, to disengage the primary body 12 and secondary body 40.

The forward bearing 80 again responds to a first rotational movement 83 of the primary body 12, regardless of the amount of the second rotational movement 85, to fixedly re-engage the primary body 12 and the secondary body 40 in a second relative position with the primary body 12 in a second relative position, indicated by the position of the body in dashed lines. The wrench device 10 of the present invention presents a significant improvement over prior art ratchet wrenches which require a discrete or finite amount of reverse rotational movement before re-engaging in a second relative position.

The wrench device 10 of the present invention presents a main body and cam, or primary and secondary bodies 12 and 40, with an infinite number of engagement points. There are an infinite number of engagement points around the circumference of the cavity and cam walls, or primary and secondary walls 32 and 42, where the bearings 80 and 82 may bind, and thus, an infinite number of fixed relationships between the primary and secondary bodies 12 and 40.

The wrench device 10 of the present invention presents a primary body 12 which instantaneously engages the secondary body 40 and drive member 50 upon the application of rotational movement in the appropriate direction. As the primary body 12 rotates in the forward rotational direction 83 the forward bearing 80 immediately binds between the primary and secondary walls 32 and 42 to immediately engage the primary body 12 and secondary body 40. The reverse bearing 80 likewise immediately binds between the primary and secondary walls 32 and 42 when the primary body 12 rotates in the reverse rotational direction 85 to immediately engage the primary and secondary bodies 12 and 40.

Figure 4:
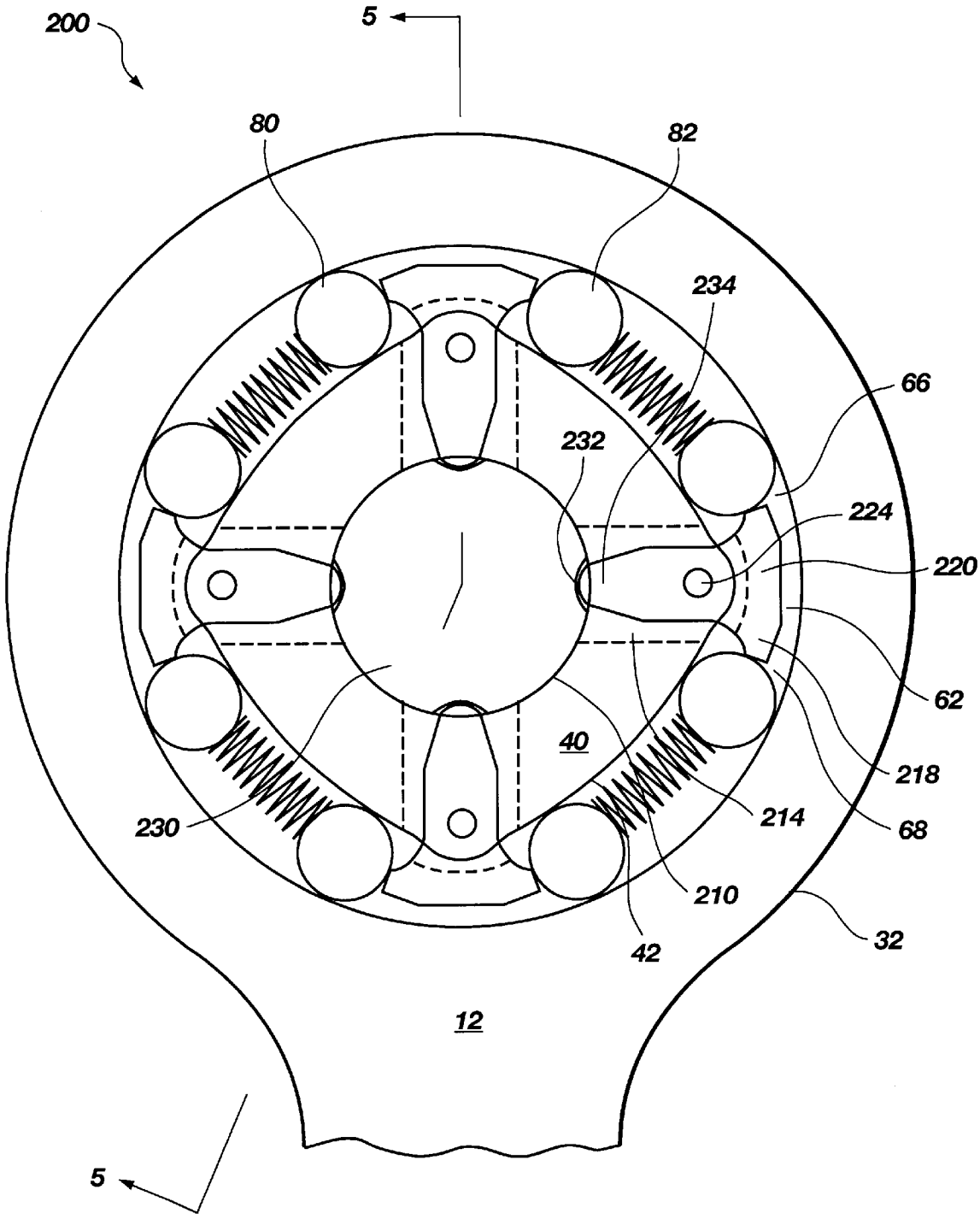
FIG. 4 is top, break-away view of another wrench device in accordance with the present invention.
Figure 5:
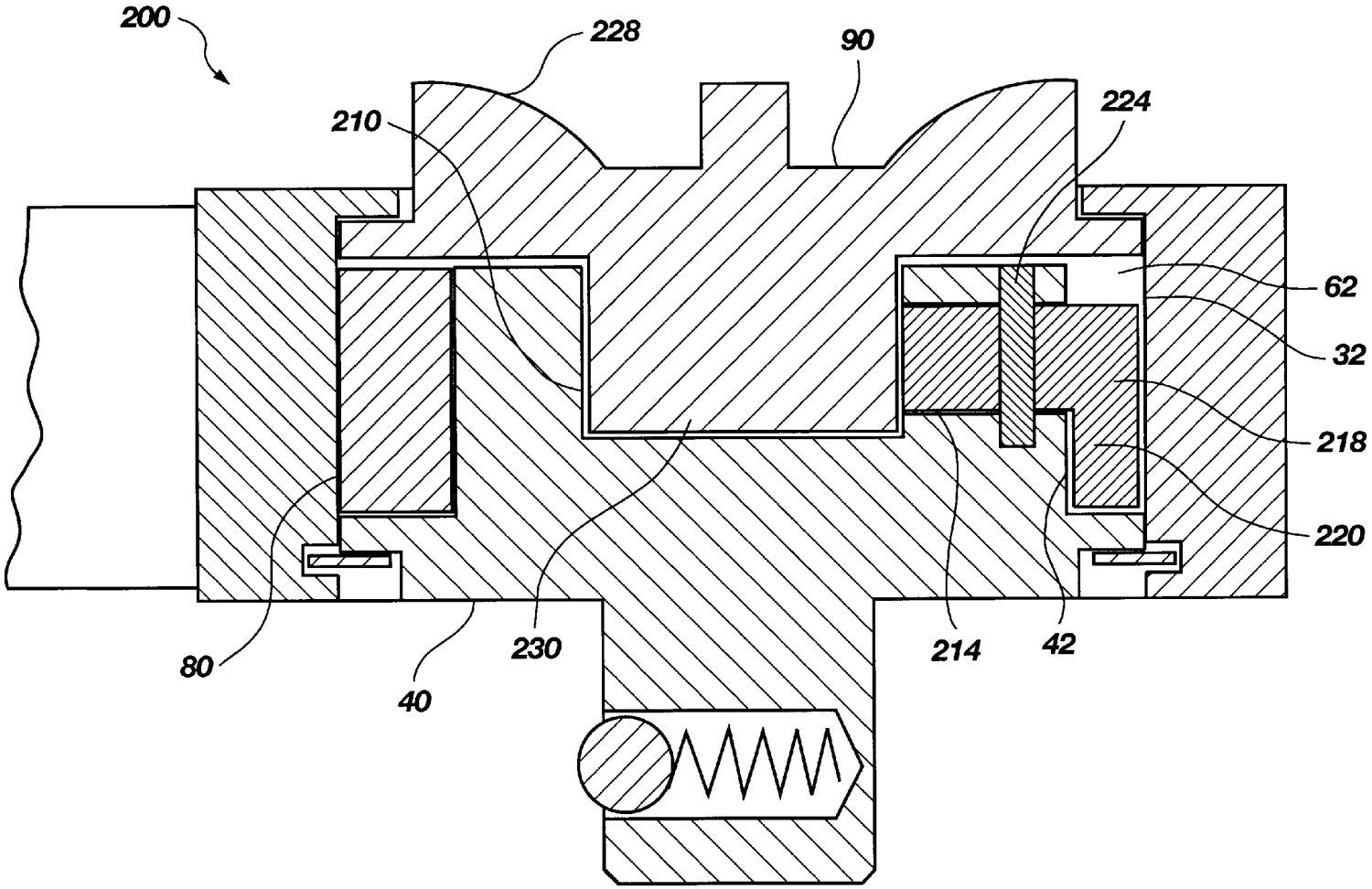
FIG. 5 is a side, cross-sectional view of the wrench device of FIG. 4, taken along section 5—5.

Referring to FIGS. 4 and 5, another wrench device 200 in accordance with the present invention is shown which is similar in many respects to the wrench device 10 described above. A longitudinal hole 210 is formed in the engagement secondary body 40, and is generally centered in the secondary body 40.

A radial bore 214 is also formed in the secondary body 40 and extends radially from the longitudinal hole 210 to the secondary wall 42. The bore 214 terminates at the secondary wall 42 near the narrow ends 66 and 68 of the space 62, or at the narrower center 64. Four radial bores 214 are formed symmetrically around the secondary body 40.

A toggle 218 is pivotally disposed in the radial bore 214 for engaging and dislodging the bearings 80 and 82. The toggle 218 has a hammer-shaped head 220 formed on one end. The head 220 is disposed in the space 62 for engaging the bearings 80 and 82. A pivot pin 224 extends through the secondary body 40, radial bore 214, and toggle 218 about which the toggle pivots. The pin 224 is disposed through the toggle 218 near the head 220 and through the secondary body 40 near the secondary wall 42.

Referring to FIG. 5, the pivot member 90 has a grip portion 228 for being gripped by a user and a cam portion 230. The cam portion 230 of the pivot member 90 extends into, or is received within, the longitudinal hole 210 of the secondary body 40. Referring to FIG. 4, an indentation 232 is formed in the cam portion 230 for operatively engaging or coupling the pivot member 90 and the toggle 218. The indentation 232 receives an end 234 of the toggle 218 opposite the head 220. Thus, as the pivot member 90 and cam portion 230 pivot, the engagement between the indentation 232 and the end 234 of the toggle 218 causes the toggle 218 to pivot. Alternatively, the indentation may receive a detent ball or pusher formed in the toggle, as discussed more fully below.

Figure 6B:
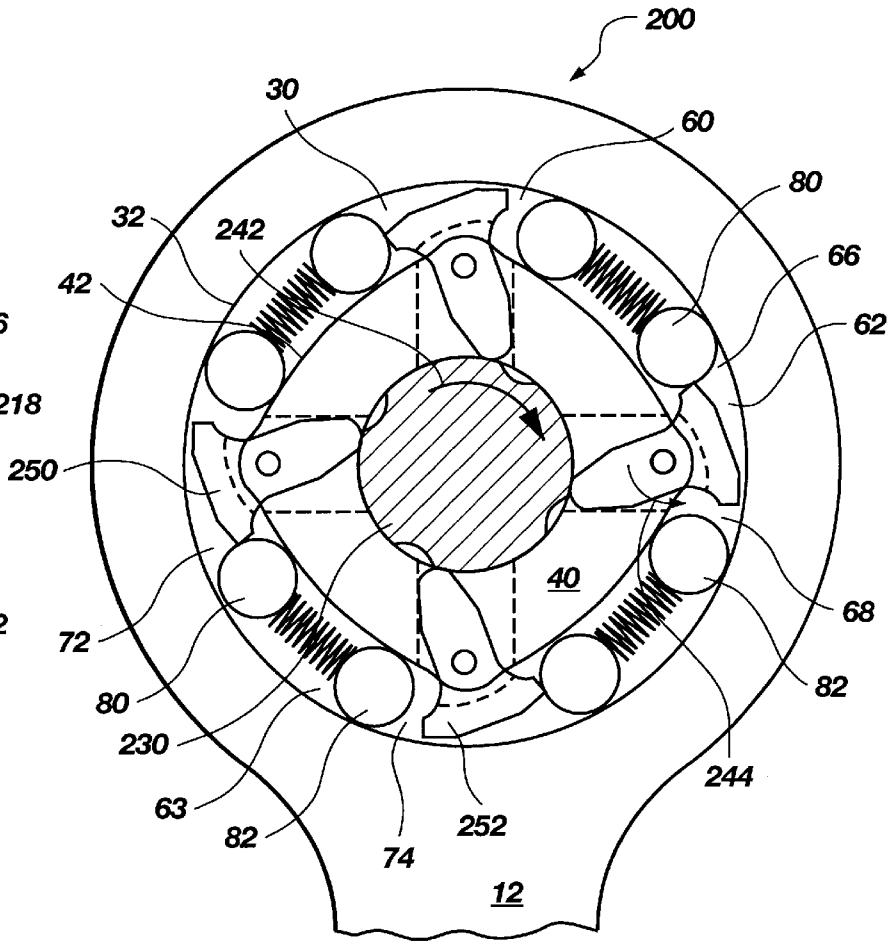
FIG. 6B is top, break-away view of the wrench device of FIG. 4, in a second position.
Figure 6A:
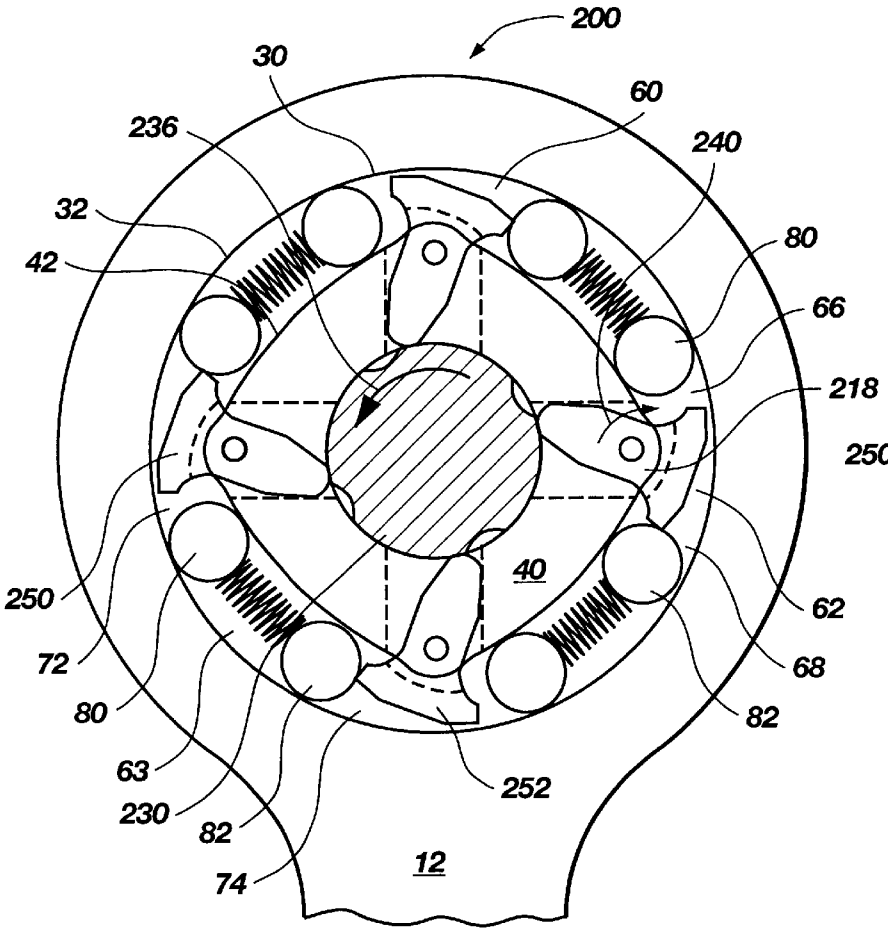
FIG. 6A is a top, break-away view of the wrench device of FIG. 4, in a first position.

Referring now to FIG. 6A, as the pivot member 90 (removed in FIG. 6A), and thus the cam portion 230, is pivoted in a first pivot direction, indicated by arrow 236, the toggle 218 pivots in a first toggle direction, indicated by arrow 240, opposite that of the pivot direction 236. As the toggle 218 pivots in the first toggle direction 240, the head 220 of the toggle contacts and dislodges the reverse bearing 82 from the reverse narrowing end 68 of the space 62. Thus, the reverse bearing 82 is prevented from binding by the toggle 218.

As the primary body 12 is rotated with respect to the secondary body 40 in the second rotational direction 85, it rotates independently of the secondary body 40, or rotates freely. As the primary body 12 is rotated with respect to the secondary body 40 in the first rotational direction 83, the forward bearing 80 binds in the forward end 66 of the space 62 between primary and secondary walls 32 and 42. Thus, the primary and secondary bodies 12 and 40 are engaged and rotate together. As shown in FIG. 6A and described above, such a configuration may be used to impart rotational force and motion to drive, or tighten, a fastener.

Referring to FIG. 6B, as the pivot member 90 (removed in FIG. 6B), and thus the cam portion 230, pivots in a second pivot direction, indicated by arrow 242, the toggle 218 pivots in a second toggle direction, indicated by arrow 244, opposite that of the pivot direction 242. As the toggle 218 pivots in the second toggle direction 242, the head 220 of the toggle contacts and dislodges the forward bearing 80 from the forward narrowing end 66 of the space 62. Thus, the forward bearing 80 is prevented from binding by the toggle 218.

As the primary body 12 is rotated with respect to the secondary body 40 in the first rotational direction 83, it rotates independently of the secondary body 40, or rotates freely. As the primary body 12 is rotated with respect to the secondary body 40 in the second rotational direction 85, the reverse bearing 82 binds in the reverse end 68 of the space 62 between primary and secondary walls 32 and 42. Thus, the primary and secondary bodies 12 and 40 are engaged and rotate together. As shown in FIG. 6B and described above, such a configuration may be used to impart rotational force and motion to loosen a fastener.

The toggle 218 is an example of another displacement means for selectively displacing one of the bearings 80 or 82 from the narrowing sections or ends 66 or 68 to prevent one of the bearings from binding.

Referring to FIGS. 6A and 6B, a pair of toggles 250 and 252 may be disposed in radial bores 214 and extend into the cavity 30 of the primary body 12, or into the space 60 between the primary and secondary walls 32 and 42. A first toggle 250 defines a forward toggle and projects into the space 63 near the forward end 72. A second toggle 252 defines a reverse toggle and projects into the space 62 near the reverse end 74. The forward toggle 250 contacts or engages the forward bearing 80 to displace or dislodge the bearing 80 from the forward narrowing end 72. Likewise, the reverse toggle 252 contacts the reverse bearing 82 to dislodge the bearing 82 from the reverse narrowing end 74. Thus, the toggles 250 and 252 each prevent either the forward or reverse bearings 80 and 82, respectively, from binding in the narrowing ends 72 and 74 between the primary and secondary bodies 12 and 40.

Referring to FIG. 6A, as the pivot member 90 (removed in FIG. 3A), and thus the cam portion 230, pivots in the first pivot direction 236 the reverse toggle 252 pivots in the first toggle direction 240 to dislodge the reverse bearing. Referring to FIG. 6B, as the pivot member (removed in FIG. 3B), and thus the cam portion 230, pivots in the second pivot direction 242, the forward toggle 250 pivots in the second toggle direction 244 to dislodge the forward bearing 80.

It will be appreciated that the operation of the wrench device 200 is similar whether one toggle 218 or two toggles 250 and 252 are used. If multiple bearing pairs are used, the difference is mostly conceptual. The toggles may be conceptualized as operating between a pair of bearings or on either side of a bearing pair. Advantageously, the wrench device 200 has four bearing pairs and four toggles 218 disposed symmetrically about the space 60 or secondary body 40. As shown, each toggle acts as both forward and reverse toggle.

Referring now to FIG. 7, the wrench device 200 is shown in an exploded view to illustrate the various components. Many of the components of the alternative embodiment of the wrench device 200 are similar to the components of the first embodiment of the wrench device 10. The alternative embodiment is shown in greater detail as it is more complicated than the first embodiment, but functions under the same principles and with many similar parts.

The wrench device 200 has a main or primary body 12, and an engagement cam or secondary body 40 with an integral drive member 50. The device 200 also has a pivot member 90 with a cam portion 230. The device 200 has a plurality of springs 86 and bearings 80 and 82. The device 200 also has a plurality of toggles 218 and a plurality of pivot pins 214. The device 200 also has a retaining ring 108.

As indicated above, the toggles 218 may have a detent ball 260, pusher or pin received within a hole 262 in the toggle 218 and biased by a spring 264. The detent ball 260 or pusher would then be received in the indentation 232 of the cam portion 230 of the pivot member 90. In addition, other detent balls 270 or pushers and springs 272 may be received within holes (not shown) in the engagement cam 40 to be received in indentations (not shown) in the pivot member 90 to maintain the relationship between the pivot member 90 and cam 40 until changed by the user.

Figure 8:
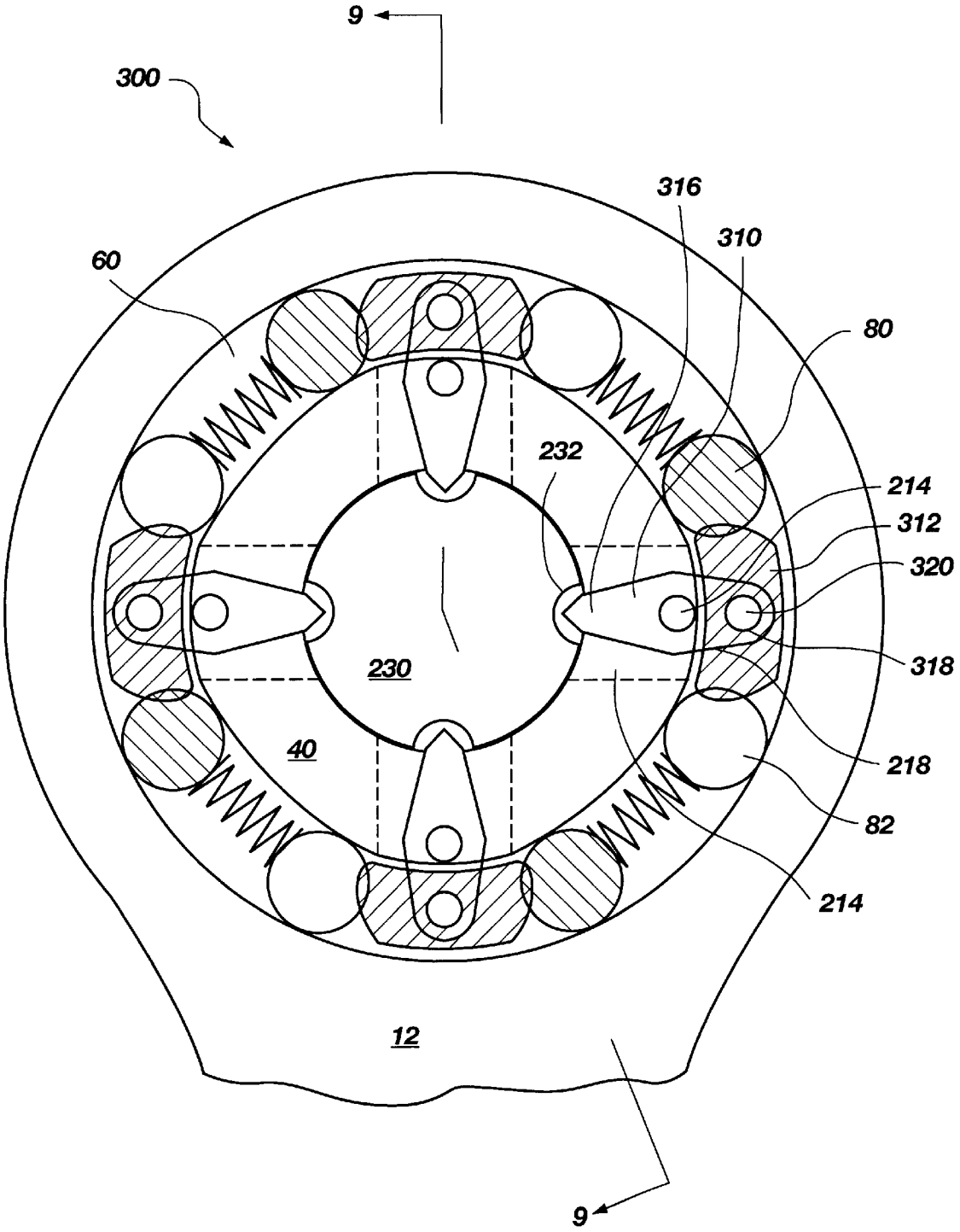
FIG. 8 is a top, break-away view of another wrench device in accordance with the present invention.
Figure 9:
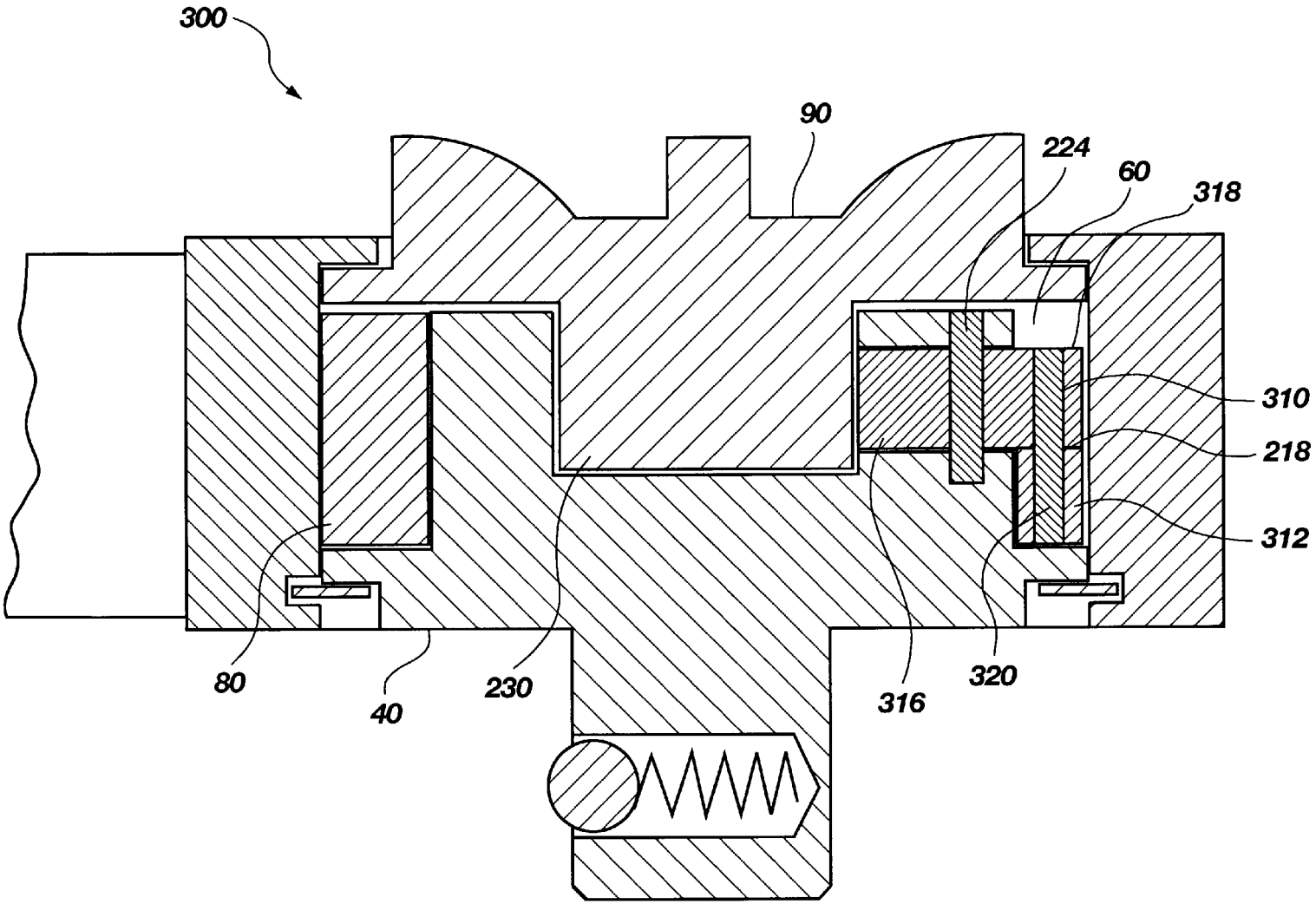
FIG. 9 is a side, cross-sectional view of the wrench device of FIG. 8, taken along section 9—9.

Referring to FIGS. 8 and 9, another wrench device 300 in accordance with the present invention is shown which is similar in many respects to the wrench device 200 described above. The toggle 218 has a swivel link 310 and a pusher member 312.

The swivel link 310 is pivotally disposed in the radial bore 214 of the secondary body 40. The swivel link 310 has a proximal end 316 and a distal end 318. The proximal end 316 of the swivel link 310 engages the indentation 232 of the cam portion 230 of the pivot member 90.

The pusher member 312 is pivotally disposed on the distal end 318 of the swivel link 310. A second pivot pin 320 is disposed in a hole formed in the swivel link 310 and a hole formed in the pusher member 312 about which the pusher member pivots. The pusher member 312 is movably disposed in the space formed between the primary and secondary bodies 12 and 40. The pusher member 312 engages and dislodges the engagement bearings 80 and 82.

Therefore, the toggle 218 of the wrench device 300 has two pivot points, the first pivot pin 214 and the second pivot pin 320. Having two pivot points allows the use of smaller bearings 80 and 82 in a smaller space 60. Whereas the toggle 218 of the previous alternative embodiment of the wrench device 200 pivoted about a single pivot point 214, a larger space 60 was required to accommodate the pivoting motion of the head portion 220 of the toggle 218 within the space 60. In the present alternative embodiment of the wrench device 300, the second pivot point 320 allows the pusher member 312 to move within the space in a sliding motion. Thus, no additional space is required with the space 60 for the pusher member 312 to pivot.

Figure 10B:
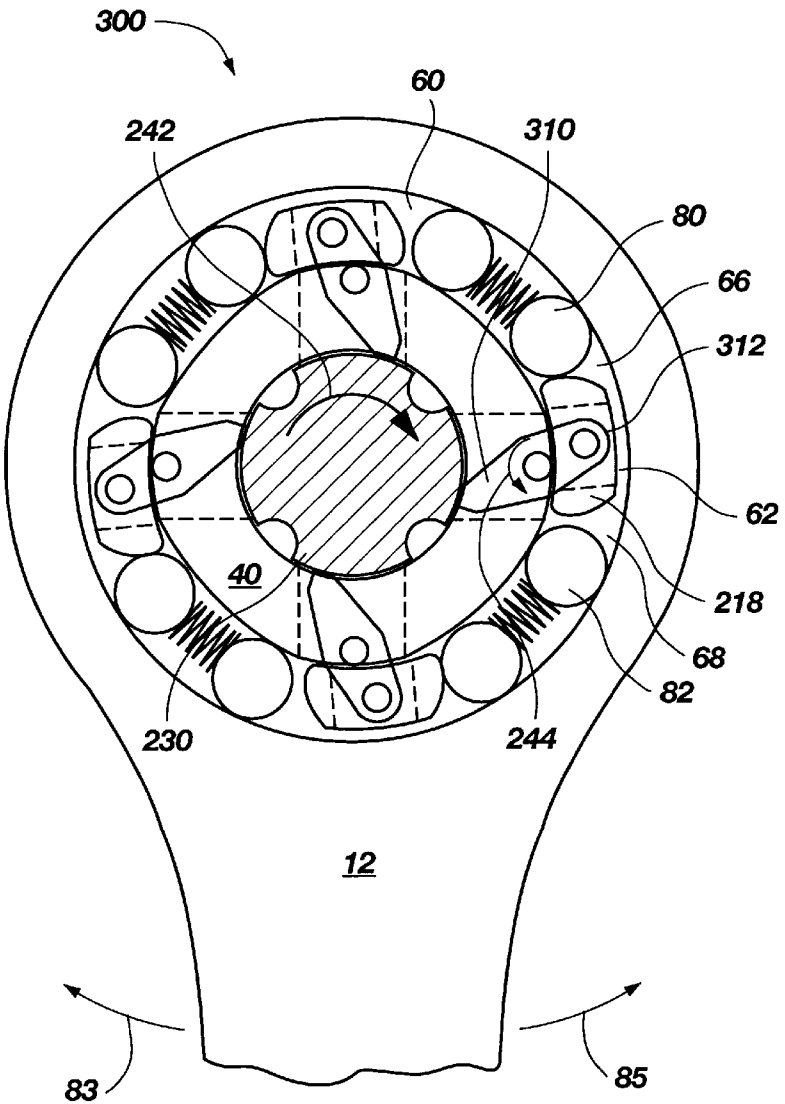
FIG. 10B is a top, break-away view of the wrench device of FIG. 8, in a second position.
Figure 10A:
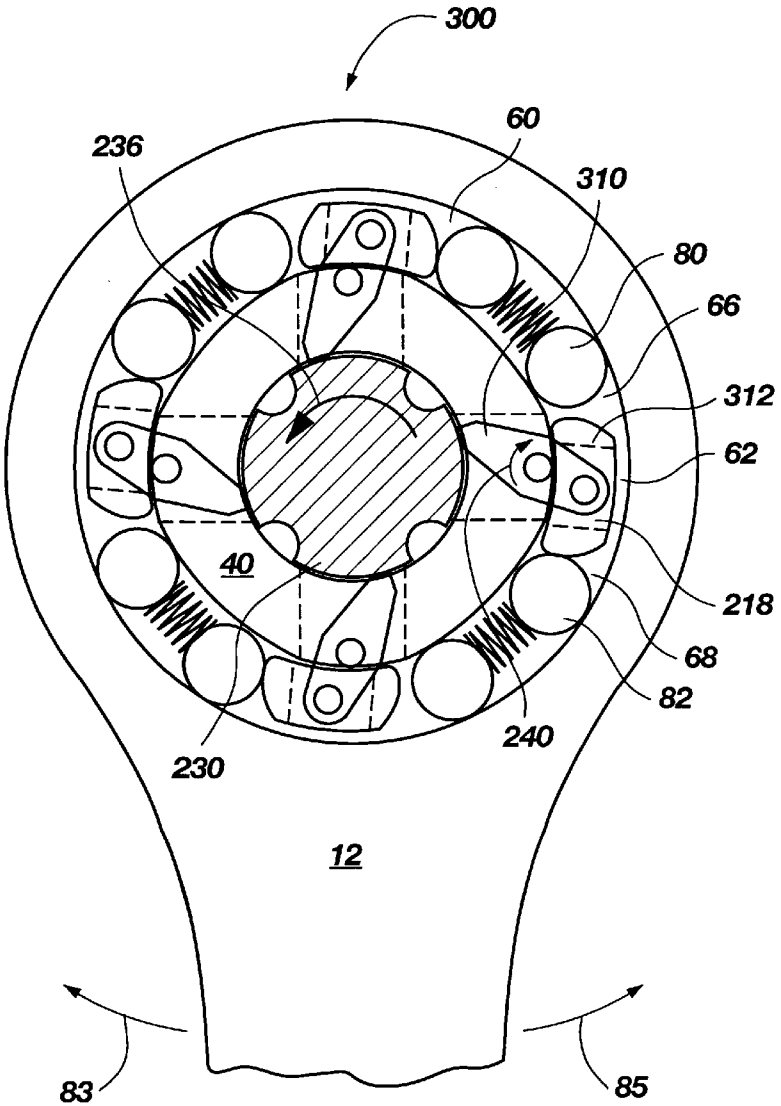
FIG. 10A is a top, break-away view of the wrench device of FIG. 8, in a first position.

Referring to FIG. 10A, as the pivot member 90 (removed in FIG. 6A), and thus the cam portion 230, is pivoted in a first pivot direction, indicated by arrow 236, the swivel link 310 pivots in a first toggle direction, indicated by arrow 240, opposite that of the pivot direction 236. As the swivel link 310 pivots in the first toggle direction 240, the pusher member 312 of the toggle 218 slides in the space 60 and dislodges the reverse bearing 82 from the reverse narrowing end 68 of the space 62. As the primary body 12 is rotated in the second rotational direction 85, it rotates independently of the secondary body 40, or rotates freely. As the primary body 12 is rotated in the first rotational direction 83, the forward bearing 80 binds in the forward end 66 of the space 62 between the primary and secondary walls 32 and 42.

Referring to FIG. lOB, as the pivot member 90 (removed in FIG. 6B), and thus the cam portion 230, pivots in a second pivot direction, indicated by arrow 242, the swivel link 310 pivots in a second toggle direction, indicated by arrow 244, opposite that of the pivot direction 242. As the toggle 218 pivots in the second toggle direction 244, the pusher member 312 of the toggle 218 slides in the space 60 and dislodges the forward bearing 80 from the forward narrowing end 66 of the space 62. As the primary body 12 is rotated in the first rotational direction 83, it rotates independently of the secondary body 40, or rotates freely. As the primary body 12 is rotated in the second rotational direction 85, the reverse bearing 82 binds in the reverse end 68 of the space 62 between the primary and secondary walls 32 and 42.

The swivel link 310 and pusher member 312 pivoting about two pivot axes is an example of another displacement means for selectively displacing one of the bearings 80 or 82 from the narrowing sections or ends 66 or 68 to prevent one of the bearings from binding.

Figure 11:
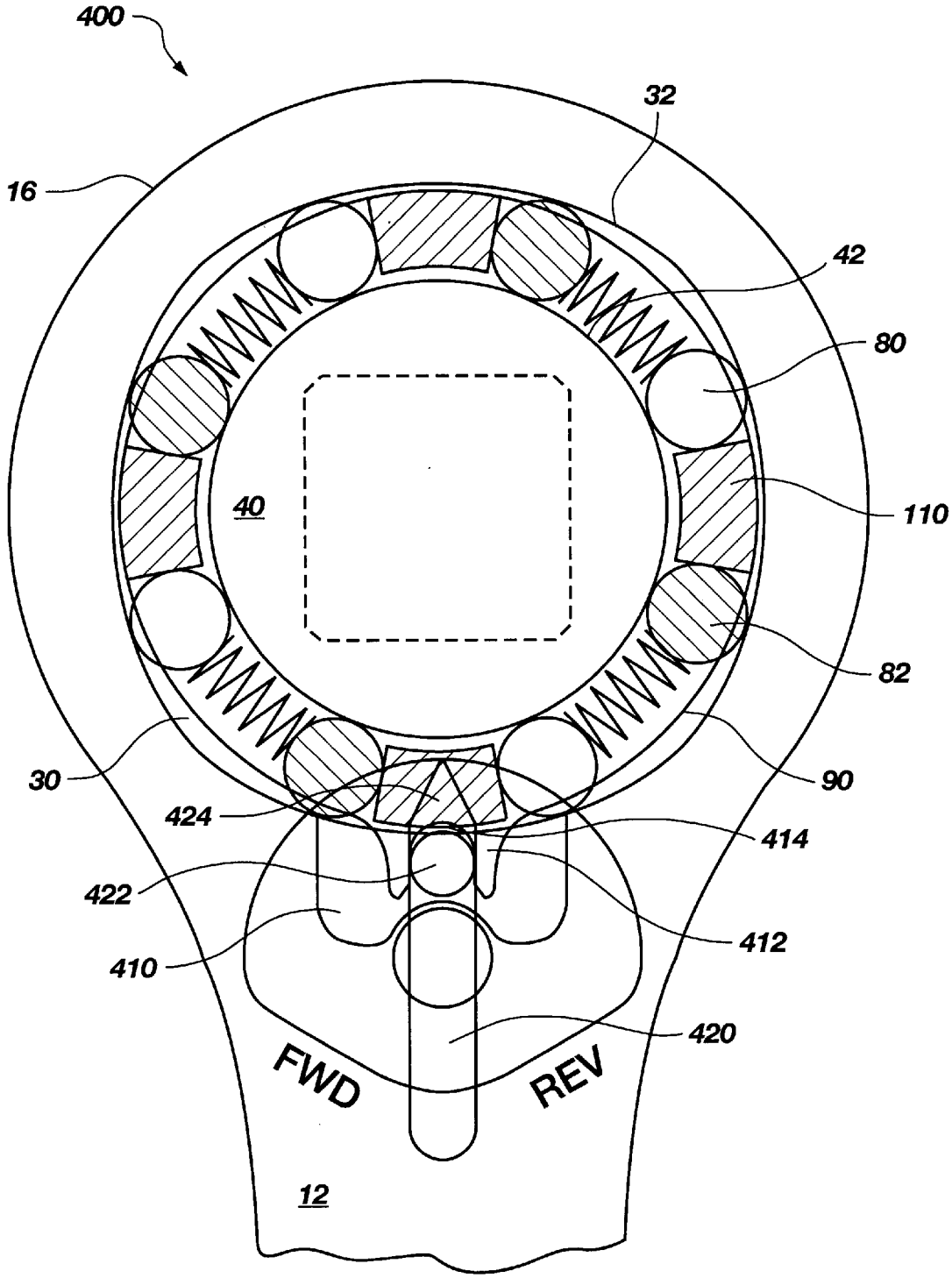
FIG. 11 is a top, break-away view of another wrench device in accordance with the present invention.

Referring to FIG. 11, another wrench device 400 in accordance with the present invention is shown which is similar in many respects to the wrench device 10 described above. A second cavity 410, or pocket, is formed in the primary body 12 adjacent the first cavity 30. Thus, the second cavity 410 is an indentation formed in the first cavity 30.

The pivot member 90 has a protrusion 412 formed thereon and extending radially outwardly from the pivot member 90 and into the second cavity 410. An indentation 414 is formed in the protrusion 412. Thus, the protrusion 412 and indentation 414 form a fork-like projection received within the second cavity 410.

A lever switch 420 is pivotally coupled to the head 16 of the primary body 12 near the second cavity 410. The lever switch 420 is disposed on the primary body 12 such that a user may conveniently engage and pivot the lever switch 420 while grasping the primary body 12. A pin 422 is formed on a distal end 424 of the lever switch 420. The pin 422 extends into the second cavity 410 and is movably disposed in the indentation 414 of the pivot member 90.

Figure 12B:
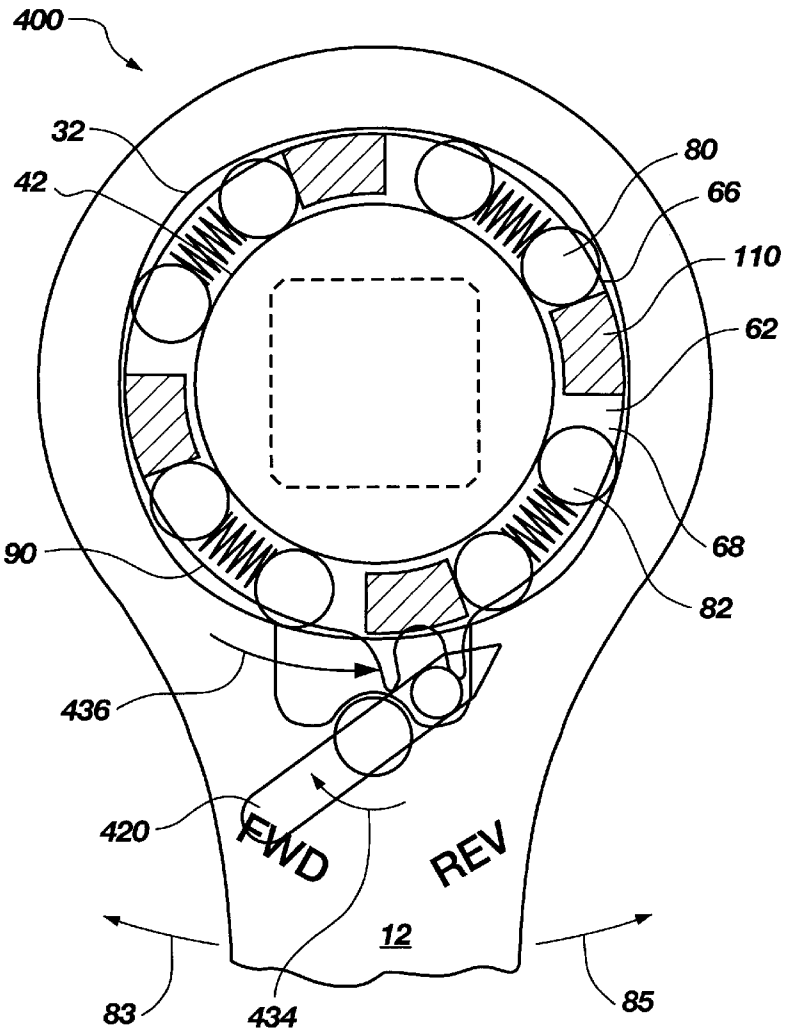
FIG. 12B is a top, break-away view of the wrench device of FIG. 11, in a second position.
Figure 12A:
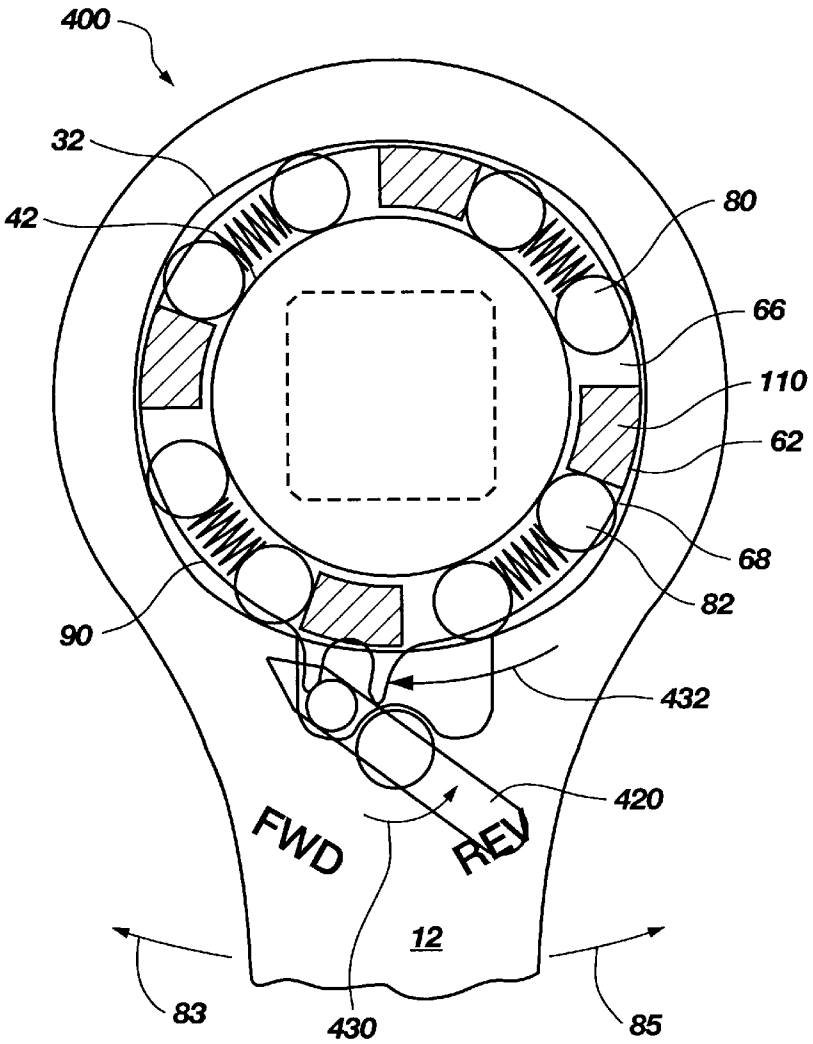
FIG. 12A is a top, break-away view of the wrench device of FIG. 11, in a first position.

Referring to FIG. 12A, as the lever switch 420 is pivoted in a first switch direction, indicated by arrow 430, the pivot member pivots in a first pivot direction, indicated by arrow 432, opposite that of the switch direction 430. As the pivot member 90 pivots in the first pivot direction 432, the bar 110 contacts and dislodges the reverse bearing 82 from the reverse narrowing end 68. As the primary body 12 is rotated in the second rotational direction 85, it rotates independently of the secondary body 40, or rotates freely. As the primary body 12 is rotated in the first rotational direction 83, the forward bearing 80 binds in the forward end 66 of the space 62 between the primary and secondary walls 32 and 42.

Referring to FIG. 12B, as the lever switch 430 pivots in a second switch direction, indicated by arrow 434, the pivot member 90 pivots in a second pivot direction, indicated by arrow 436, opposite that of the switch direction 434. As the it pivot member 90 pivots in the second pivot direction 436, the pin 110 contacts and dislodges the forward bearing 80 from the forward narrowing end 66 of the space 62. As the primary body 12 is rotated in the first rotational direction 83, it rotates independently of the secondary body 40, or rotates freely. As the primary body 12 is rotated in the second rotational direction 85, the reverse bearing 82 binds in the reverse end 68 of the space 62 between the primary and secondary walls 32 and 42.

The lever switch 420 engaging the protrusion 412 of the pivot member 90 with a pin 110 is an example of another displacement means for selectively displacing one of the bearings 80 or 82 from the narrowing sections or ends 66 or 68 to prevent one of the bearings from binding.

Referring again to FIG. 11, the secondary wall 42 is circular while the primary wall 32 is non-circular.

Figure 13:
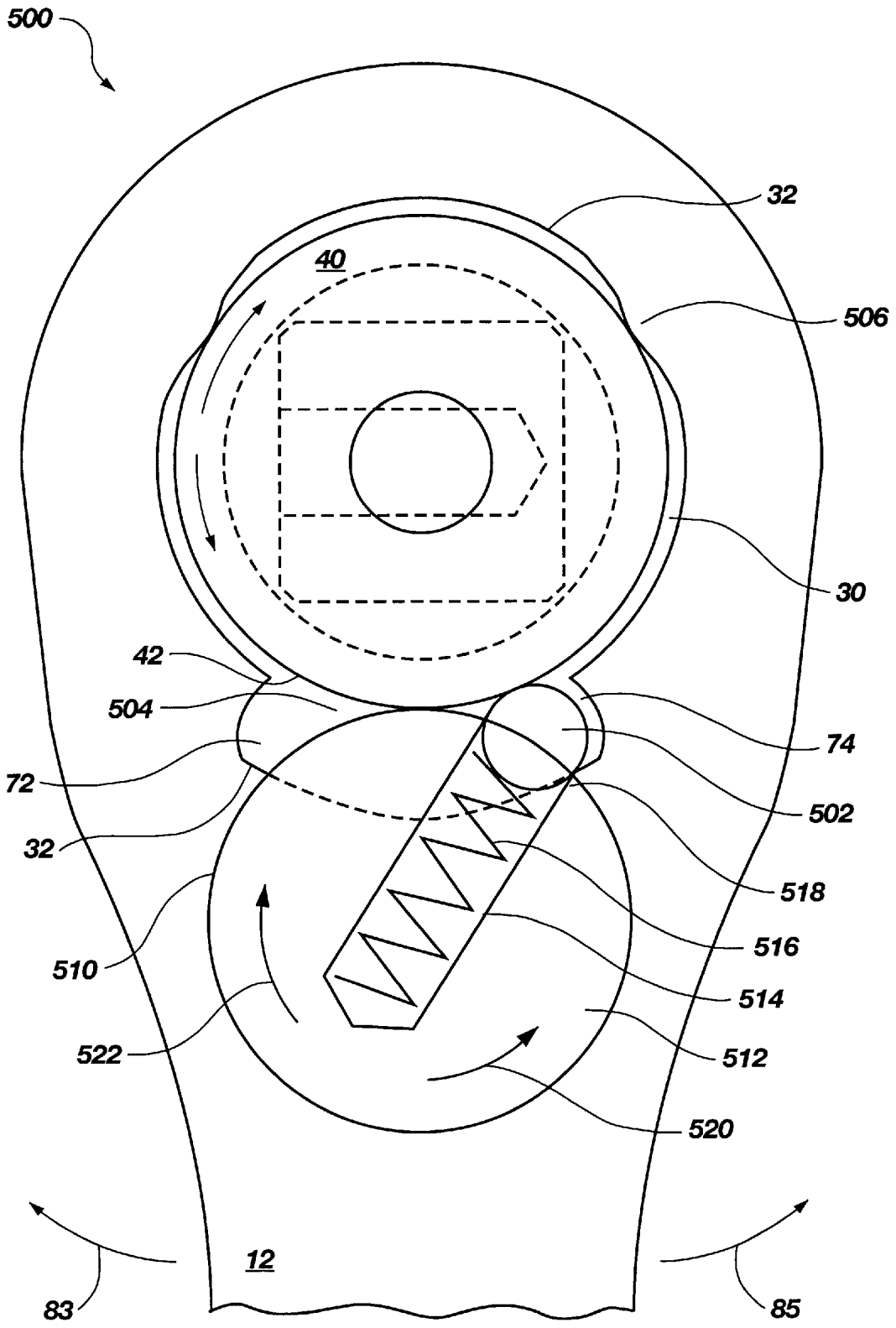
FIG. 13 is a top, break-away view of another wrench device in accordance with the present invention.

Referring now to FIG. 13, another wrench device 500 in accordance with the present invention is shown which is similar in many respects to the wrench device 10 described above, but utilizes a single engagement bearing 502 and a single space 504. The space 504 has a first, or forward, narrowing section 72 and a second, or reverse, narrowing section 74. In addition, a plurality of protrusions 506 are formed on the cavity wall 32 against which the engagement cam 40 slides or binds.

A second cavity 510, or pocket, is formed in the primary body 12 adjacent the first cavity 30. Thus, the second cavity 510 is an indentation formed in the first cavity 30. The second cavity 510 may be cylindrically shaped, as shown, and intersect or overlap the primary cavity 30.

A pivot member 512 is disposed in the second cavity 510 and is pivotally coupled to the primary body 12. A recess 514 is formed in the pivot member 512 and extends radially therefrom to the space 504. A tab (not shown) or other gripping means may be formed on the pivot member for a user to grasp and pivot the pivot member. The pivot member 512 may be disposed on the primary body 12 such that a user may conveniently engage and pivot the pivot member 512 while grasping the primary body 12. The pivot member 512 may be cylindrically shaped, as shown.

The bearing 502 is partially disposed within the recess 514 of the pivot member 512. The bearing 502 is biased out of the recess 514 by a spring 516. As the pivot member 512 pivots, an end 518 of the recess 514 is rotated towards the engagement cam 40, forcing the bearing 502 into the recess. As the pivot member 512 is pivoted towards the narrowing sections 72 and 74, the bearing 502 is forced partially out of the recess 514 and into one of the narrowing sections 72 or 74. In addition, the spring 516 forces the bearing 502 into contact with the secondary wall 42 and primary wall 32 which causes the bearing to bind, engaging the primary body 12 and the secondary body 40.

As the pivot member 512 pivots in a first pivot direction, indicated by arrow 520, the bearing 502 is positioned in the first, or forward, narrowing section 72. As the primary body 12 is rotated in the first rotational direction 83, the bearing 502 binds in the forward section 72 of the space 504 between the primary and secondary walls 32 and 42. As the primary body 12 is rotated in the second rotational direction 85, it rotates independently of the secondary body 40, or rotates freely.

As shown in FIG. 13, as the pivot member 512 is pivoted in a second pivot direction, indicated by arrow 522, the bearing 502 is positioned in the second, or reverse, narrowing section 74. As the primary body 12 is rotated in the second rotational direction 85, the bearing 502 binds in the reverse section 74 of the space 504 between the primary and secondary walls 32 and 42. As the primary body 12 is rotated in the first rotational direction 83, it rotates independently of the secondary body 40, or rotates freely.

The spring 516 biases the bearing 502 into the reverse section 74 of the space 504 and into contact with both the primary and secondary walls 32 and 42. But, the spring 516 allows the bearing 502 to move back slightly and slide along the primary and secondary walls 32 and 42 as the primary body 12 rotates with respect to the secondary body 40 in the first rotational direction 83.

The pivot member 512 with a recess 514 is an example of a positioning means for selectively positioning the bearing in one of the narrowing sections. In this embodiment of the wrench device 500, the secondary wall 42 is circular while the primary wall 32 is non-circular.

Figure 14:
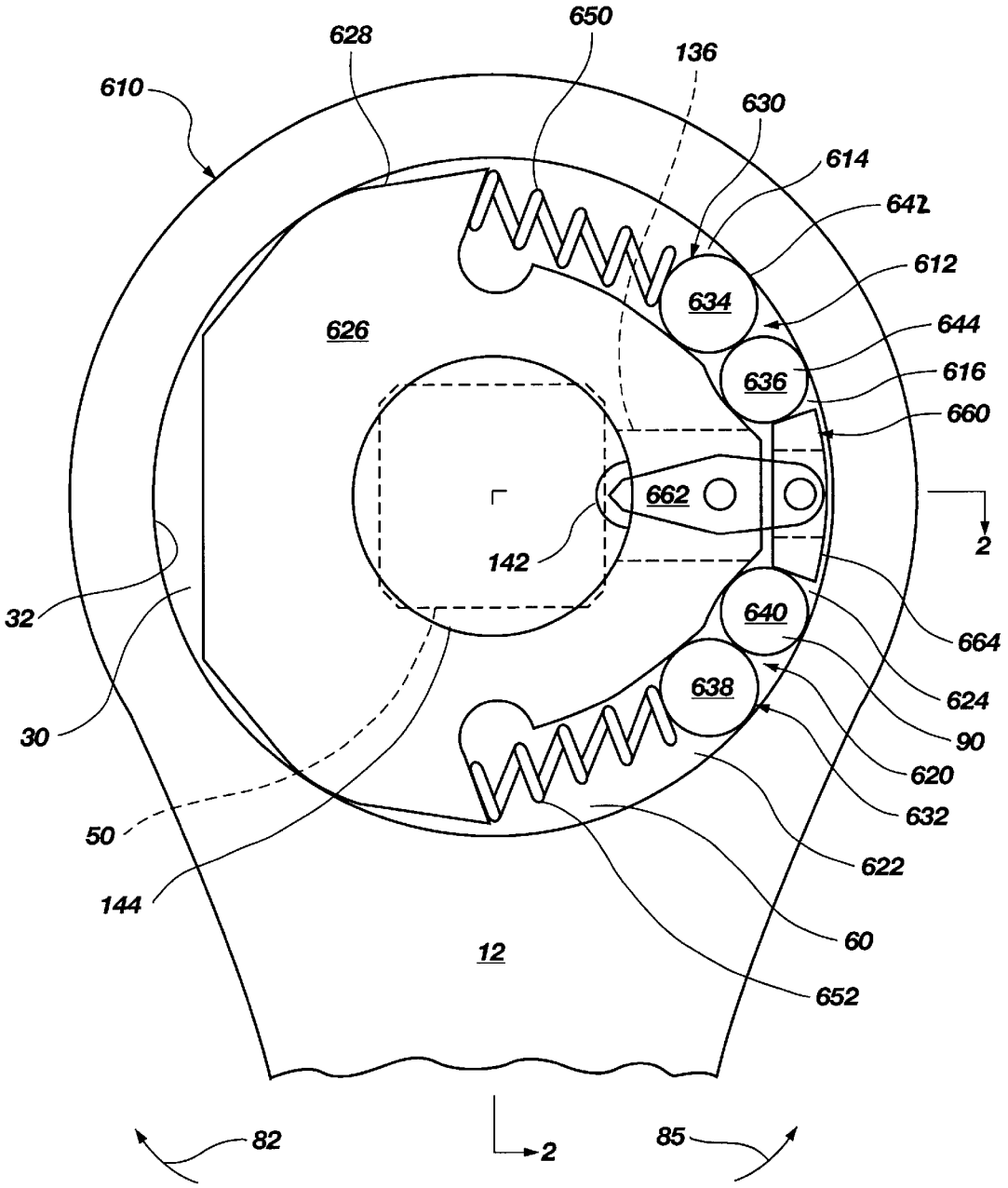
FIG. 14 is a top, break-away view of another wrench device in accordance with the present invention.
Figure 15B:
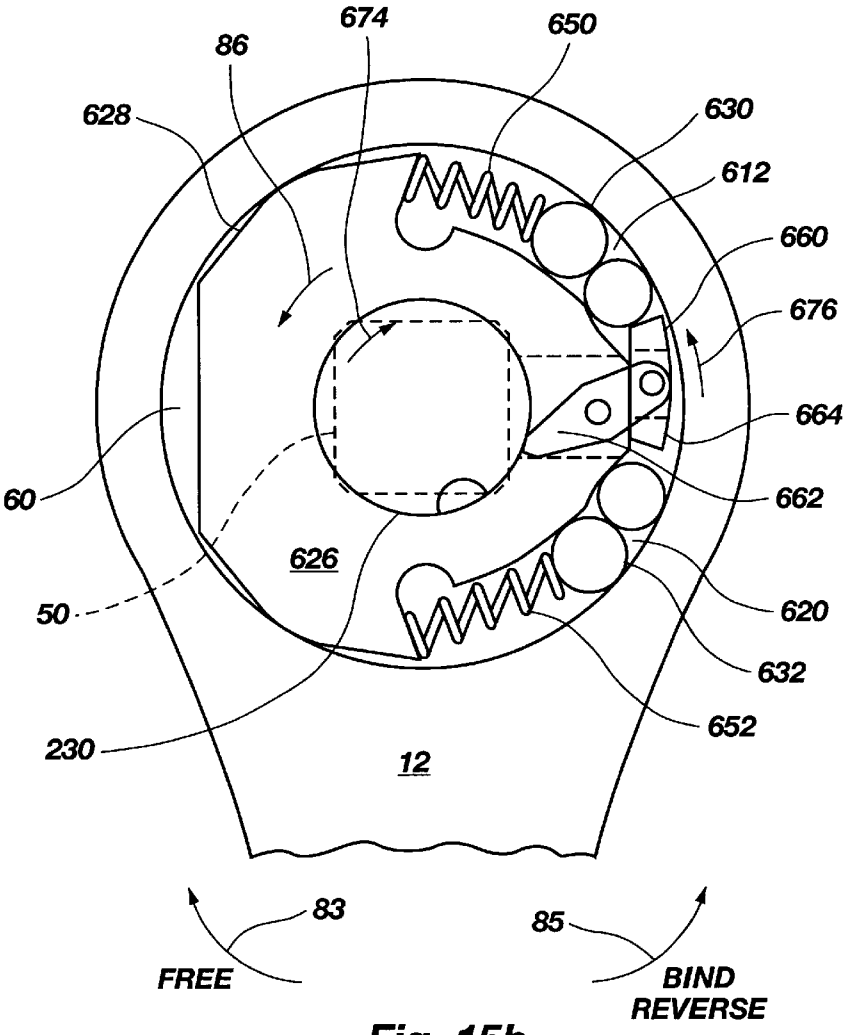
FIG. 15*b* is a top, break-away view of the wrench device of FIG. 14, shown in a second position.

Referring to FIGS. 14–15*b*, a wrench device, indicated generally at 610, in accordance with the present invention is shown, which is similar in many respects to those described above. The space 60 of the wrench device 610 includes at least one, or a first, tapering space 612, which tapers or narrows from a larger portion to a smaller portion. The tapering space 612 advantageously includes at least two differently sized sections, including a larger tapering section 614, and a smaller tapering section 616. Both sections 614 and 616 taper or narrow in the same direction.

In addition, the space 60 may include a second tapering space 620, which has at least two differently sized sections, including a larger tapering section 622, and a smaller tapering section 624. The tapering spaces 612 and 620 may taper or narrow towards one another, as shown in FIG. 14, or away from one another, as discussed below.

The device 610 includes a cam or secondary body 626 with a cam or secondary wall 628. The secondary wall 628 may be shaped or have indentations to form the tapering spaces 612 and 620. In addition, the secondary wall 628 also may bear against the primary wall 32 of the primary body 12 so that the primary and secondary bodies 12 and 626 contact and bear against each other, as shown.

A first set of engagement bearings 630 is disposed in the first tapering space 612 between the primary wall 32 and the secondary wall 628. Similarly, a second set of engagement bearings 632 is disposed in the second tapering space 620. The first set of bearings 630 advantageously includes at least two, differently sized bearings, including a larger bearing 634 and a smaller bearing 636. Likewise, the second set of bearings 632 includes larger and smaller bearings 638 and 640. The first set 630 of larger and smaller bearings 634 and 636 are movably disposed in the respective larger and smaller tapering spaces 614 and 616 of the first tapering space 612, while the second set 632 of larger and smaller bearings 638 and 640 are disposed in the respective larger and smaller tapering spaces 622 and 624 of the second tapering space 620.

The bearings are movable between a free location and a binding location. In the free location, the bearings move away from the tapering spaces, or in a direction opposite the direction of narrowing. In the binding location, the bearings move towards the tapering or narrowing spaces, and bind between the primary and secondary bodies 12 and 626. As a set of bearings binds, the bearings advantageously provide two or more points of contact between the primary and secondary bodies at a single tapering space. For example, as the first set of bearings 630 move to the binding location, or clockwise in FIG. 14, each bearing 634 and 636 extends between the primary and secondary bodies 12 and 626, or between the primary and secondary walls 32 and 628, resulting in at least two points of contact or engagement 642 and 644.

The bearings are dimensioned to bind in the narrowing spaces to engage the primary body 12 with the secondary body 626. The first set of bearings 630 defines a forward bearing set disposed in the first tapering space 612 to bind as the primary body 12 moves in a first or forward rotational direction 83. The second set of bearings 632 defines a reverse bearing set disposed in the second tapering space 620 to bind as the primary body 12 moves in a second or reverse rotational direction 85. As the bearings bind, the secondary wall 628 of the secondary body 626 contacts and bears against the primary wall 32 of the primary body 12, as shown.

Figure 15A:
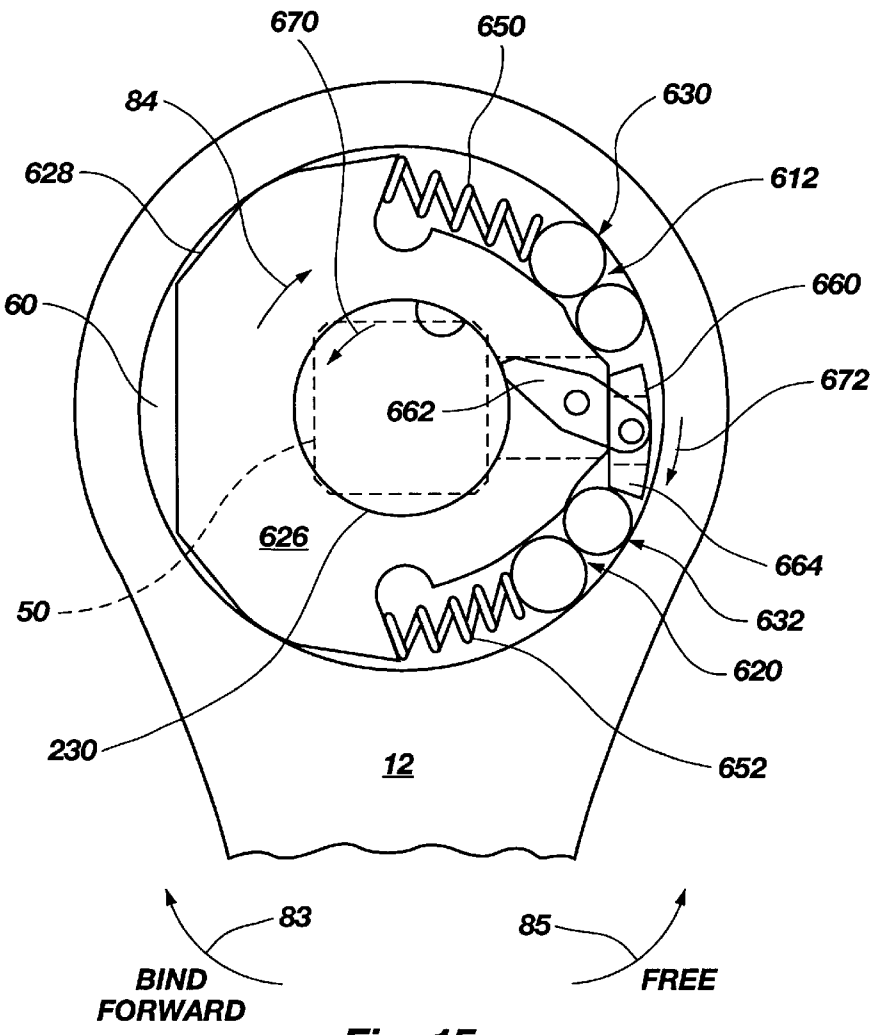
FIG. 15*a* is a top, break-away view of the wrench device of FIG. 14, shown in a first position.

Referring to FIG. 15*a*, the first or forward bearing set 630 binds between the cavity wall 32 and the cam wall 628 as the main body 12 rotates with respect to the engagement cam 626 in a first rotational direction, or in a forward rotational direction, indicated by the arrow 83. The rotation of the primary body 12 caused the first bearing set 630 to move to the binding location, as shown. The forward bearing set 630 causes the secondary body 626, and thus the drive member 50, to engage and rotate with the primary body 12, as indicated by arrow 84. It will be appreciated that the forward rotational direction 83 (clockwise in FIG. 15*a*) may be used to drive or tighten standard fasteners, when the first bearing set 630 binds in the first tapering cavity 612.

Referring to FIG. 15*b*, the second or reverse bearing set 632 binds between the primary wall 32 and the secondary wall 628 as the primary body 12 rotates with respect to the secondary body 626 in a second rotational direction, or in a reverse rotational direction, indicated by the arrow 85. The rotation of the primary body 12 caused the second bearing set 632 to move to the binding location, as shown. The reverse bearing set 632 causes the secondary body 626, and thus the drive member 50, to engage and rotate with the primary body 12, as indicated by arrow 86. It will be appreciated that the reverse rotational direction 85 (counter-clockwise in FIG. 15*b*) may be used to loosen standard fasteners, when the second bearing set 632 binds in the second tapering cavity 620.

Referring again to FIG. 14, a first spring 650 is disposed in the space 60 for biasing the first bearing set 630 towards the first tapering space 612, and into the binding location. Similarly, a second spring 652 is disposed in the space 60 for biasing the second bearing set 632 towards the second tapering space 620, and the binding location. The springs are one example of a biasing means for biasing the bearings towards the tapering spaces, and towards the binding location.

A toggle 660 may be used to displace the bearing sets 630 and 632. The toggle 660 has a swivel link 662 and a pusher member 664 which is movably disposed in the space 60 formed between the primary body 12 and the secondary body 626. The pusher member 664 engages and dislodges the bearing sets 630 and 632. The toggle 660 is one example of a displacement means for displacing the bearings away from the tapering spaces or tapering section, and away from the binding location. Other displacement means may be used, including for example, pins formed on the pivot member 90, toggles without pivoting pusher members, etc.

Referring to FIG. 15*a*, as the pivot member 90 (removed in FIG. 15*a*), and thus the cam portion 230, is pivoted in a first pivot direction, indicated by arrow 670, the swivel link 662 pivots in a first toggle direction, indicated by arrow 672, opposite that of the pivot direction 670. As the swivel link 662 pivots in the first toggle direction 672, the pusher member 664 of the toggle 660 slides in the space 60 and dislodges the second or reverse bearing set 632 from the second tapering space 620, and to a free location, as shown. As the primary body 12 is rotated in the second rotational direction 85, it rotates independently of the secondary body 626, or rotates freely. As the main body 12 is rotated in the first rotational direction 83, the first or forward bearing set 630 binds in the first tapering space 612 between the primary and secondary walls 32 and 42. Therefore, the device 610 is shown in FIG. 15*a* in a configuration for driving, or tightening, a fastener in the clockwise direction. Typically, a right handed thread is used. It is of course understood that if a left handed thread is used then the rotational directions for tightening and loosening must be reversed.

Referring to FIG. 15*b*, as the pivot member 90 (removed in FIG. 15*b*), and thus the cam portion 230, pivots in a second pivot direction, indicated by arrow 674, the swivel link 662 pivots in a second toggle direction, indicated by arrow 676, opposite that of the pivot direction 674. As the toggle 660 pivots in the second toggle direction 676, the pusher member 664 of the toggle 660 slides in the space 60 and dislodges the first or forward bearing set 630 from the first tapering space 612, and towards a free location, as shown. As the primary body 12 is rotated in the first rotational direction 83, it rotates independently of the secondary body 626, or rotates freely. As the primary body 12 is rotated in the second rotational direction 85, the second or reverse bearing set 632 binds in the second tapering space 620 between the primary and secondary walls 32 and 42. Therefore, the device 610 is shown in FIG. 15*b* in a configuration for loosening a fastener in the counterclockwise direction.

Figure 16B:
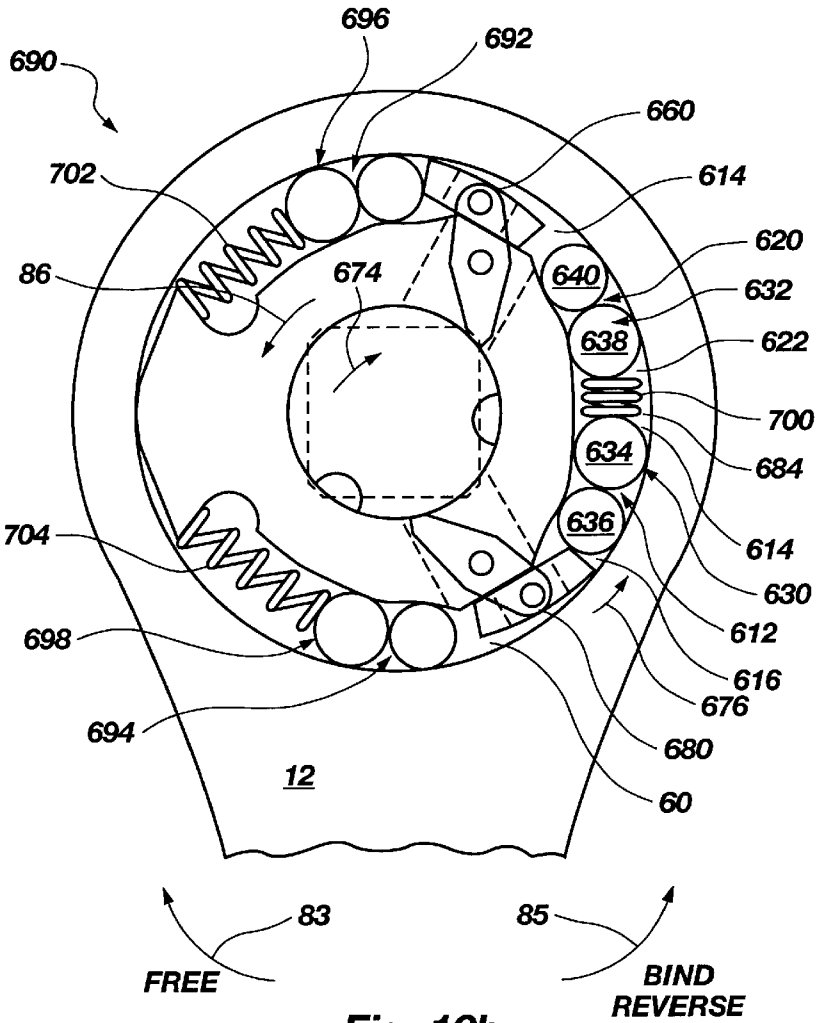
FIG. 16*b* is a top, break-away view of the wrench device of FIG. 16*a*, shown in a second position.
Figure 16A:
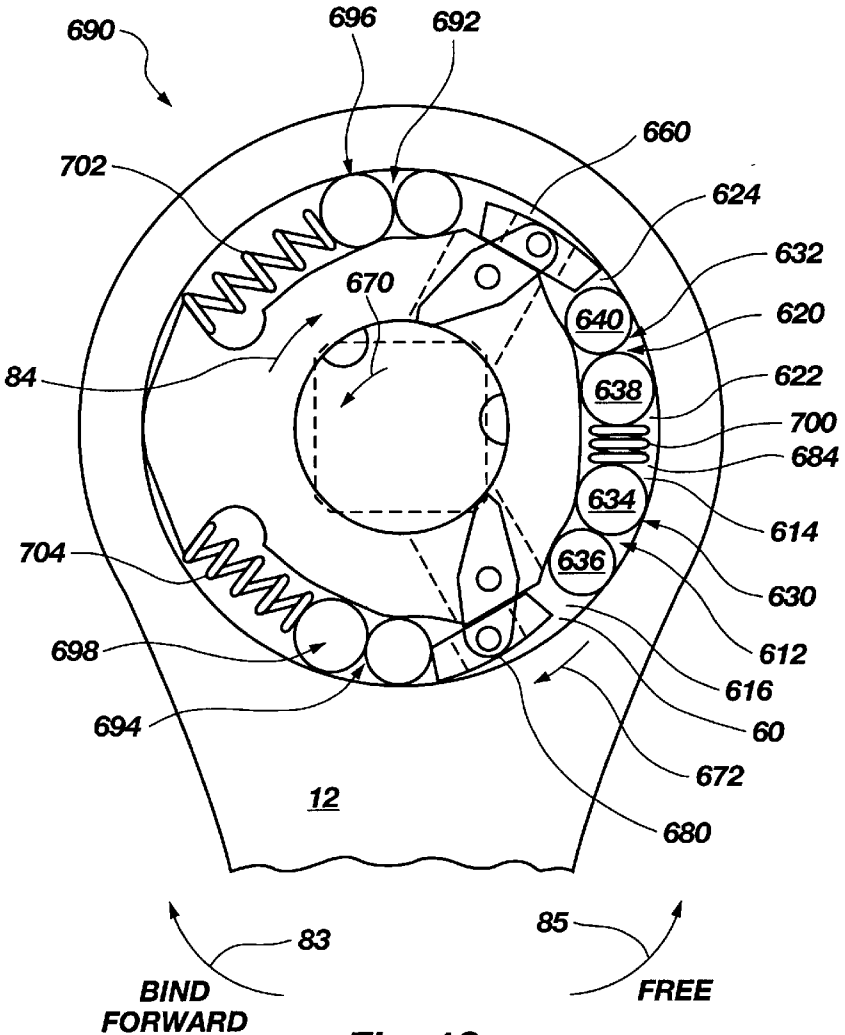
FIG. 16*a* is a top, break-away view of another wrench device in accordance with the present invention, shown in a first position.

As described above, the first and second tapering spaces 612 and 620 may taper or narrow towards one another, with the toggle 660, or other displacement means, disposed between the tapering spaces 612 and 620, and between the first and second sets of bearings 630 and 632. Alternatively, the first and second tapering spaces 612 and 620 may be configured to taper or narrow away from one another, as shown in FIGS. 16*a* and 16*b*, with the toggle 660 disposed on one side, and a second toggle 680 disposed on the other side of the tapering spaces 612 and 620, and of the first and second sets of bearings 630 and 632. In such a configuration, the larger tapering spaces 614 and 622 may be combined to form a single larger tapering space 684 with the smaller tapering spaces 616 and 624 disposed on both sides, and including both larger bearings 634 and 638.

In addition, referring to FIGS. 16*a* and 16*b*, another device 690 in accordance with the present invention may be configured with multiple bearing sets and multiple tapering spaces. The device 690 is similar to the device 610 described above, but includes additional third and fourth tapering spaces 692 and 694. The third and second tapering spaces 692 and 620 taper or narrow towards one another, while the fourth and first tapering spaces 694 and 612 taper or narrow towards one another. It will be appreciated that the third and second tapering spaces, and the fourth and first tapering spaces, are similar to the first and second tapering spaces described above. In addition, the device 690 includes third and fourth bearing sets 696 and 698 disposed in respective third and fourth tapering spaces 692 and 694.

A single spring 700 may be disposed in the larger tapering space 684 between the bearing sets 630 and 632 to bias the bearing sets 630 and 632 towards the respective tapering spaces 612 and 620, and into the binding location. In addition, springs 702 and 704 may be disposed on opposite sides from the single spring 700. The springs are one example of a biasing means for biasing the bearings towards the binding location.

Figure 17B:
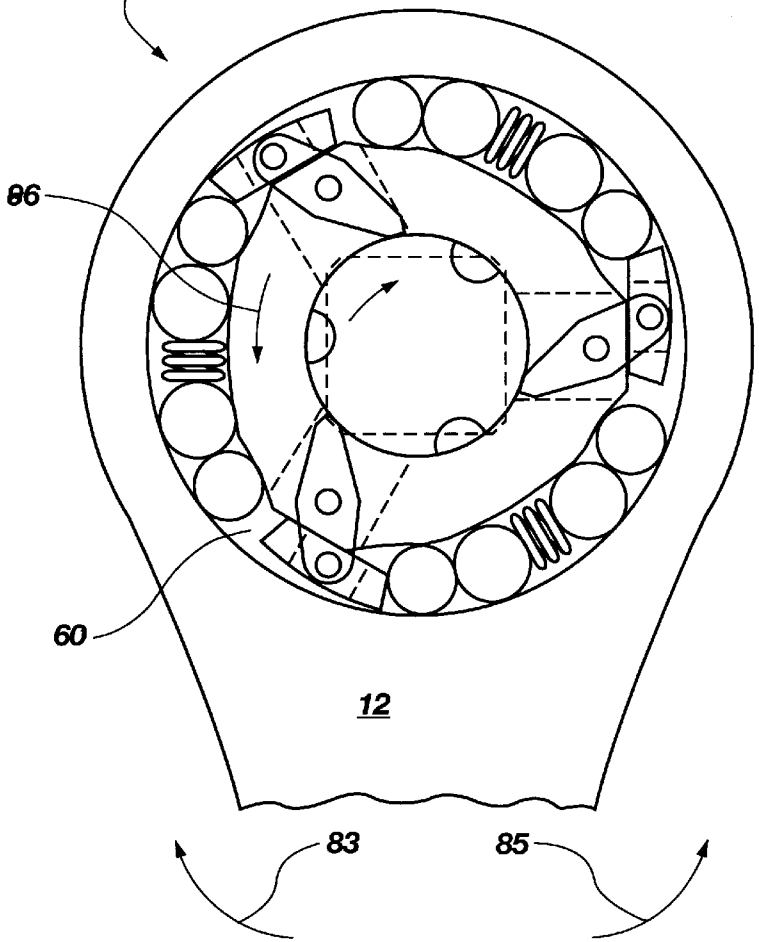
FIG. 17*b* is a top, break-away view of the wrench device of FIG. 17*a*, shown in a second position.
Figure 17A:
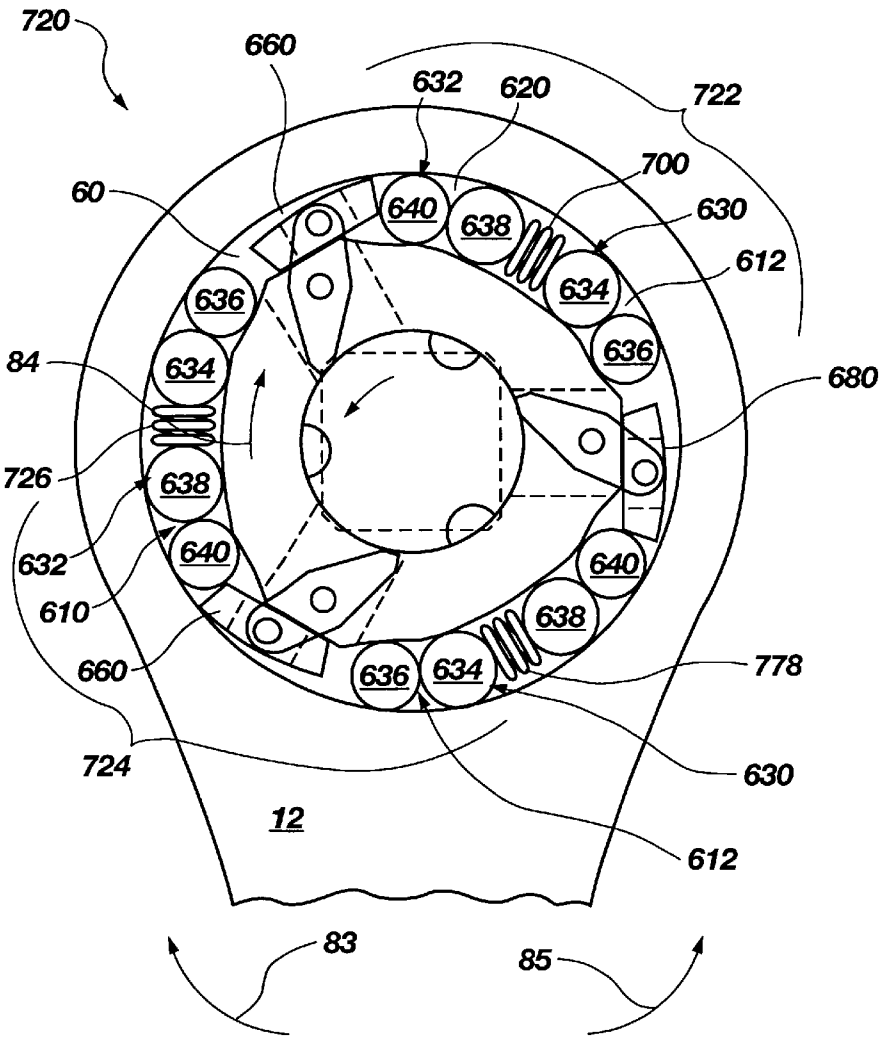
FIG. 17*a* is a top, break-away view of another wrench device in accordance with the present invention, shown in a first position.

As shown in FIGS. 17*a* and 17*b*, another device 720 is shown in accordance with the present invention which includes multiple tapering spaces and multiple bearing sets equally spaced about the space 60. The device 720 includes three pairs of first and second tapering spaces 612 and 620, each with larger and smaller tapering sections, and first and second bearing sets 630 and 632, each with larger and smaller bearings. Toggles 660 may be disposed between each of the three pairs, or on opposite sides of each of the three pairs. Similarly, springs may be disposed between each of the three pairs, or on opposite sides of each of the three pairs. Thus, each of the three pairs may be conceptualized as indicated at 722, or as toggles 660 and 680 disposed on each side of a set of tapering spaces 612 and 620, and a set of bearings 630 and 632 with a spring 700 disposed therebetween.

Alternatively, each of the three pairs may be conceptualized as indicated at 724, or as springs 726 and 728 disposed on each side of a set of tapering spaces 612 and 620, and a set of bearings 630 and 632, with a toggle 660 disposed therebetween. It will be appreciated that the difference is mostly conceptual. Each set of bearings advantageously provides two points of contact or engagement between the primary and secondary bodies.

Figure 18B:
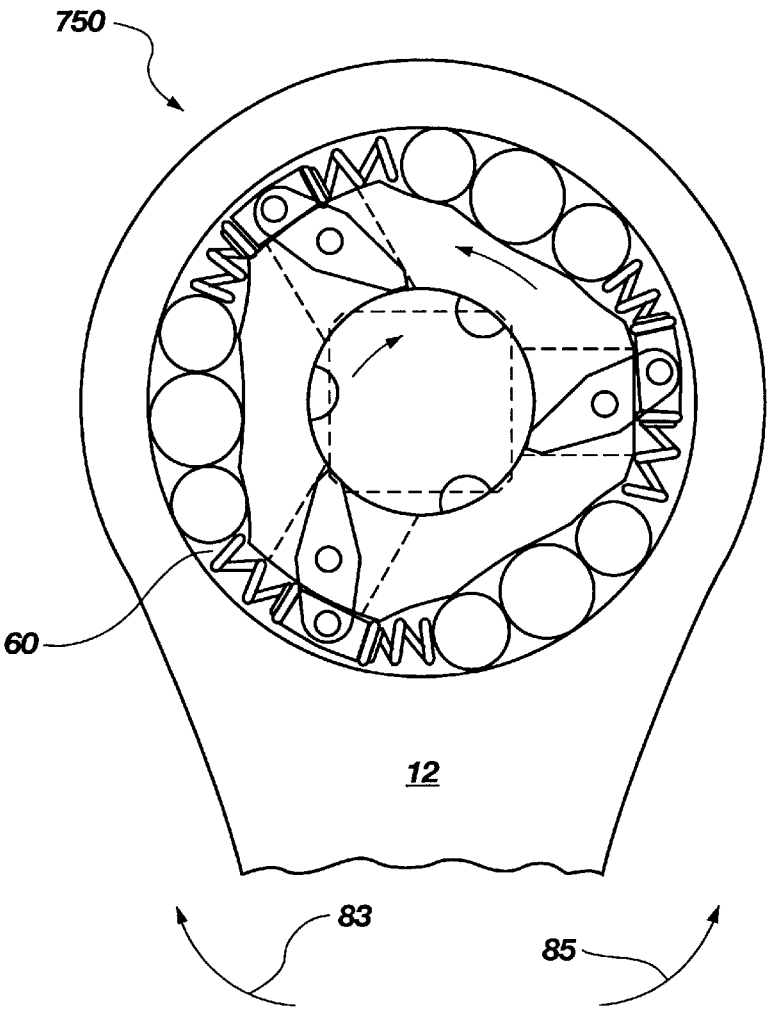
FIG. 18*b* is a top, break-away view of the wrench device of FIG. 18*a*, shown in a second position.
Figure 18A:
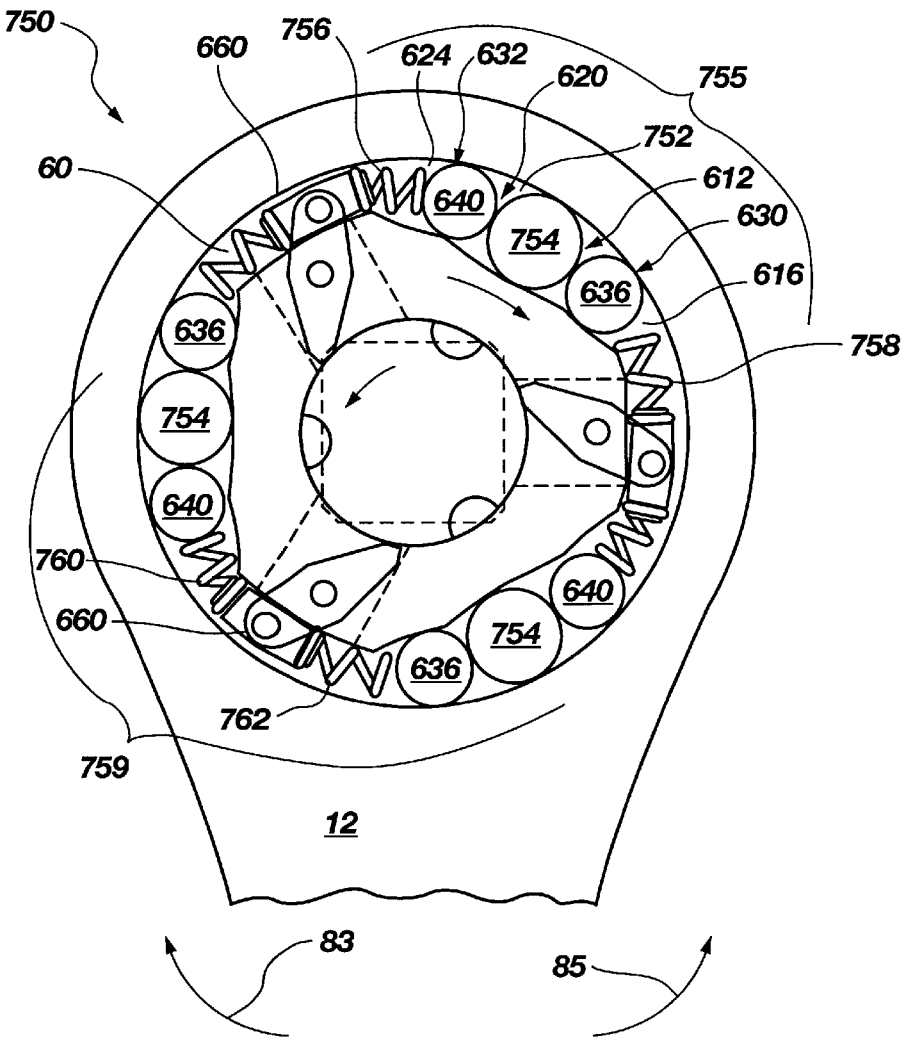
FIG. 18*a* is a top, break-away view of another wrench device in accordance with the present invention, shown in a first position.

Referring to FIGS. 18*a* and 18*b*, another device 750 is shown in accordance with the present invention in which the first and second tapering spaces 612 and 620 share a single larger tapering section 752, and the first and second sets of bearings 630 and 632 share a single larger bearing 754. Again, the device 750 may include one or more pairs of tapering spaces and bearing sets, which may be conceptualized as indicated at 755, or with smaller tapering sections 616 and 624 disposed on opposite sides of the larger tapering section 752, and smaller bearings 636 and 640 disposed on opposite sides of the larger bearing 754. Toggles 660 and 680, and springs 756 and 758, are disposed on both sides. The springs 756 and 758 may contact and bear against the toggles 660 and 680, as shown.

Alternatively, the device 750 may be conceptualized as indicated at 759, or with a toggle 660, and springs 760 and 762, disposed in the middle. Thus, the device 750 advantageously reduces the number of bearings while maintaining two points of contact or engagement per bearing set.

Figure 19A:
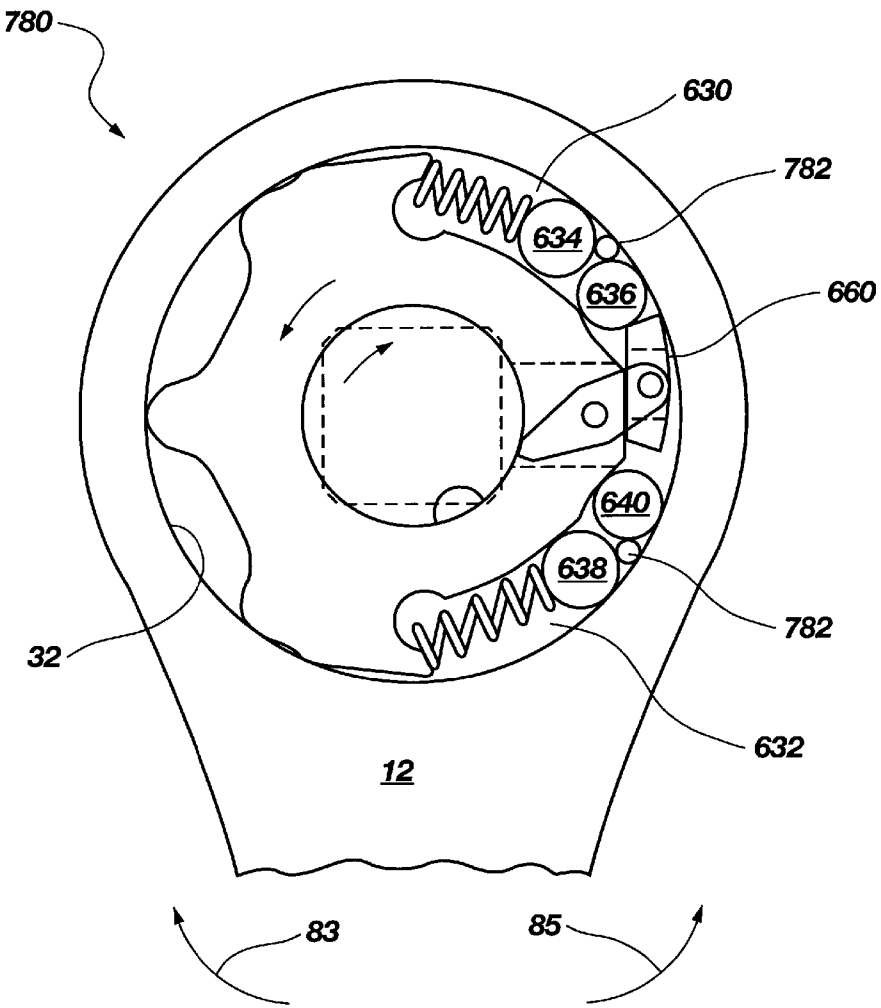
FIG. 19*a* is a top, break-away view of another wrench device in accordance with the present invention, shown in a first position.
Figure 19A:
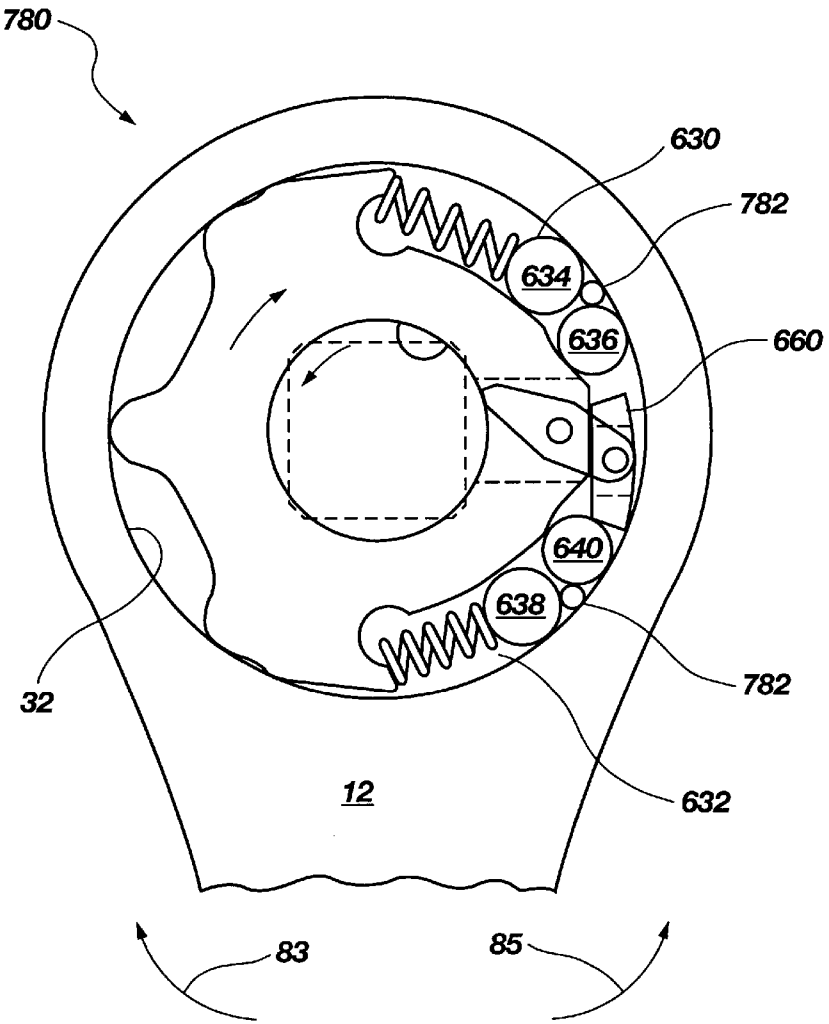

Referring to FIGS. 19*a* and 19*b*, another device 780 in accordance with the present invention includes a third bearing 782 in each bearing set 630 and 632, which is smaller than both bearings 634 and 636 or 638 and 640 in the sets. The third bearing 782 is disposed between the bearings in the sets, and creates a third point of contact or engagement against the primary wall 32 of the primary body 12 for each bearing set.

Figure 20:
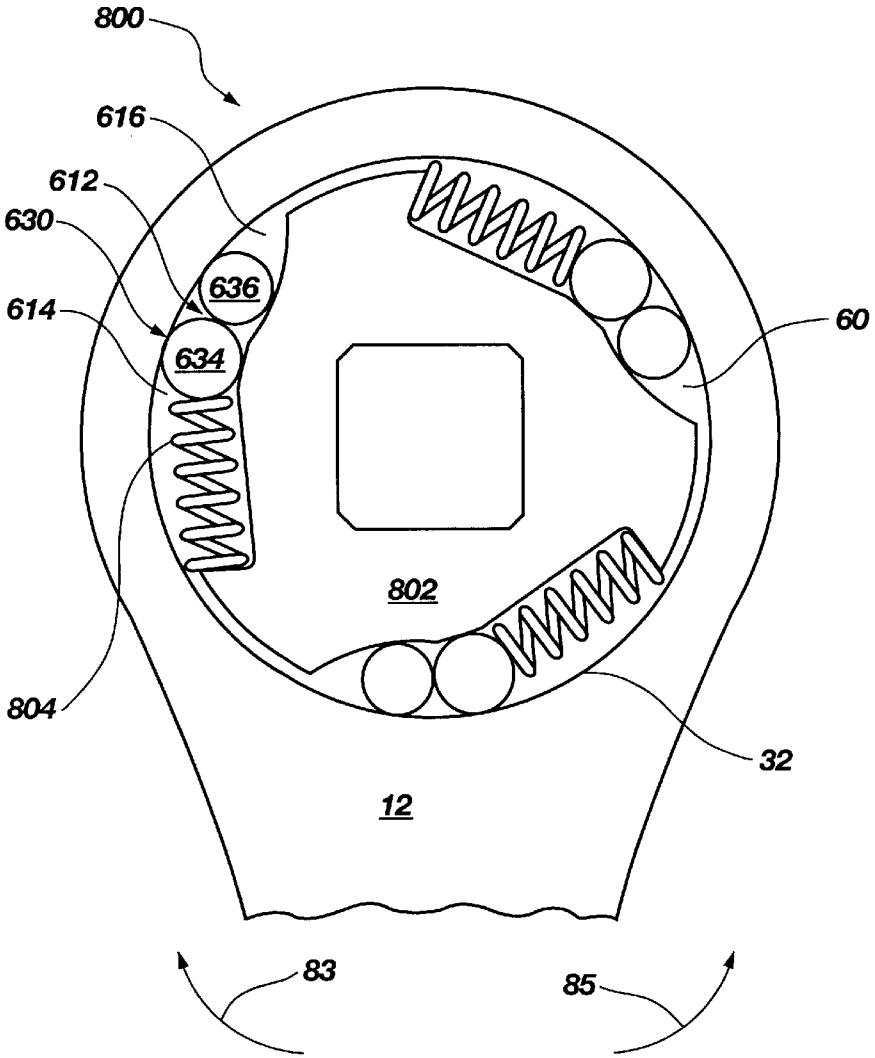
FIG. 20 is top, break-away view of another wrench device in accordance with the present invention.

Referring to FIG. 20, another device 800 in accordance with the present invention is shown which is unidirectional. Again, a tapering space 612 includes larger and smaller tapering sections 614 and 616, and a bearing set 630 includes larger and smaller bearings 634 and 636, disposed in the respective larger and small tapering sections 614 and 616. Again, the device 800 may have three pairs of tapering spaces and bearing sets.

Because the device 800 is unidirectional, a cam or secondary body 802 has a drive member 50 on both sides (only one side shown). Thus, the one drive member, or one side of the device, may be used to drive in the first rotational direction 83, and move freely in the second rotational direction 85, as shown. The other drive member, or other side of the device, may be used to loosen in the first rotational direction, and move freely in the second rotational direction.

The bearings 634 and 636 bind between the primary and secondary bodies 12 and 802 as the primary body moves in the first rotational direction 83. The spring 804 biases the bearings 634 and 636 towards the tapering sections 614 and 616, and into the binding location, as shown. As the primary body 12 moves in the second rotational direction 85, the bearings 634 and 636 move to a free location.

Figure 21:
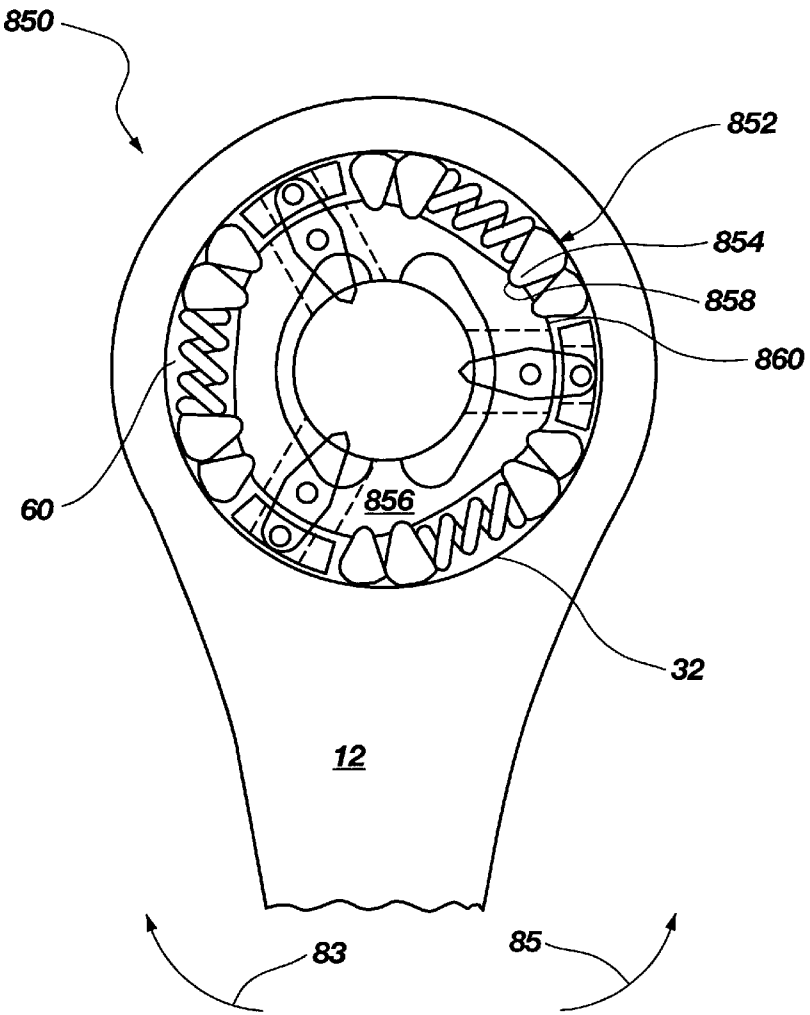
FIG. 21 is top, break-away view of another wrench device in accordance with the present invention.

Referring to FIG. 21, another device 850 is shown with bearings 852 which are non-circular, or non-cylindrical. The bearings 852 may have a tear-drop-like shape with a protrusion 854. A secondary body 856 includes indentations 858 formed in the secondary wall 860 which receive the protrusions 854 of the bearings 852. Thus, the bearings 852 pivot about the indentations 858 and protrusions 854.

Although many of the engagement bearings above have been shown as cylindrical-type bearings, it is of course understood that any type of bearing may be used. For example, the engagement bearings may be ball bearings, barrel bearings, pin bearings, roller bearings, etc. In addition, the bearings may be circular or non-circular as discussed below. The engagement bearings may be of any appropriate length or diameter.

In addition, although the present invention has been illustrated and described with particular reference to a wrench device, it is of course understood that the present invention may be applied to any primary and secondary bodies for reversibly and selectively engaging the bodies. For example, a screwdriver device, fishing reel, bike, etc. may also use the principals of the present invention.

It will be appreciated that the structures and apparatus disclosed herein are merely exemplary of engagement means for engaging the primary and secondary bodies, and displacement means for dislodging the bearings, and it should be appreciated that any structure, apparatus or system for engaging and/or displacing which performs functions the same as, or equivalent to, those disclosed herein are intended to fall within the scope of a means for engaging and a means for displacing, including those structures, apparatus or systems for engaging and/or displacing which are presently known, or which may become available in the future. Anything which functions the same as, or equivalently to, a means for engaging or means for displacing falls within the scope of this element.

In accordance with the features and combinations described above, a method of driving and/or removing a fastener using the wrench device described above includes coupling an appropriately sized socket to the drive member of the device and the fastener. The socket has a first cavity sized and configured for engaging a fastener and a second cavity sized and configured for receiving the drive member.

To drive, or tighten, the fastener, the pivot member or lever switch is pivoted in a first pivot direction, which may be clockwise or counter clockwise depending on the pivot member or lever switch used. Pivoting the pivot member causes the pins or toggles to contact and dislodge the reverse bearings from the reverse sections of the nonuniform space.

The main body is then rotated in a first rotational direction, or clockwise. As the main body is rotated in the first rotational direction, the forward bearings bind in the forward sections of the nonuniform space between the cavity and cam walls. The forward bearings bind instantly as the main body rotates. As the forward bearings bind, the main body and cam fixedly engage in a first fixed relationship with the main body in a first relative position with respect to the cam. As the main body and cam rotate together in the first rotational direction, the fastener is tightened.

As the main body is rotated in the second rotational direction, the forward bearings move back slightly from the forward sections of the space and slide along the walls. The main body and cam disengage instantly as the main body rotates. Only a small amount of rotational movement in the second rotational direction is required for the main body and cam to disengage. As the main body rotates in the second rotational direction, it rotates independently of the cam.

As the main body is again rotated in the first rotational direction, the forward bearings again instantly bind between the walls, re-engaging the main body and cam. The main body and cam are fixedly re-engaged in a second fixed relationship with the main body in a second relative position. In addition, the main body and cam re-engage regardless of the amount of rotation of the main body in the second rotational direction. Therefore, the device may be used in very tight spaces where angular or rotational movement of the main body is severely restricted because the bearings re-engage the main body and cam in a second relative position regardless of the amount of rotation of the main body in the second rotational direction.

To loosen the fastener, the pivot member or lever switch is pivoted in the second pivot direction. As the pivot member pivots, the pins or toggles contact and dislodge the forward bearings from the forward narrowing sections of the space.

The operation of the device is then similar as that described above only in opposite directions.

The pivot member 90 with tabs 96 (FIG. 2) or grip portion 228 (FIG. 5) or the lever switch 420 (FIG. 11) are examples of switching means for switching the wrench between a right and left direction of travel.

It is to be understood that the detent ball described above may be a pin, pusher, or similar device.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A bearing clutch device, comprising:

a) a secondary body rotatably coupled to a primary body forming a tapering space therebetween which includes larger and smaller tapering sections; and b) larger and smaller bearings, movably disposed in the respective larger and smaller tapering sections, and movable between a free location, and a binding location in which the larger and smaller bearings form two points of engagement between the primary and secondary bodies at the tapering space.

2. A device in accordance with claim 1, wherein the larger and smaller bearings (i) fixedly engage the primary and secondary bodies in a first fixed relationship with the primary body in a first relative position, responsive to rotational movement of the primary body in a first rotational direction, (ii) disengage the primary and secondary bodies, responsive to an amount of rotational movement of the primary body in a second rotational direction, and (iii) fixedly re-engage the primary and secondary bodies in a second fixed relationship with the primary body in a second relative position, responsive to rotational movement of the primary body in the first rotational direction and regardless of the amount of rotational movement of the primary body in the second rotational direction.

3. A device in accordance with claim 1, further comprising:

displacement means for displacing the larger and smaller bearings from the binding location to the free location.

4. A device in accordance with claim 1, further comprising:

a) a pivot member, pivotally coupled to the primary body;

b) a swivel link, engaged by the pivot member and pivotally coupled to the secondary body; and c) a pusher member, pivotally disposed on the end of the swivel link, to engage and dislodge the larger and smaller bearings.

5. A device in accordance with claim 1, further comprising:

biasing means, disposed between the primary and secondary bodies, for biasing the larger and smaller bearings towards the respective larger and smaller tapering spaces, and towards the binding location.

6. A device in accordance with claim 1, further comprising:

a) at least two tapering spaces, formed between the primary and secondary bodies, including first and second tapering spaces tapering in opposite directions, and each having at least two different size tapering sections including a larger tapering section and a smaller tapering section;

b) at least two sets of bearings, each set movably disposed in one of the at least two tapering spaces, including first and second sets of bearings disposed in the respective first and second tapering spaces, and each set having at least two different size bearings including a larger bearing and a smaller bearing movably disposed in the respective larger and smaller tapering sections the first and second sets of bearings each being selectively movable between binding and free locations; and c) displacement means for selectively displacing one of the first and second sets of bearings from the binding location to the free location, to prevent the displaced set of bearings from binding, such that displacement of the first set of bearings from the first tapering space allows the primary body to rotate independently with respect to the secondary body in a second rotational direction, and such that displacement of the second set of bearings from the second tapering space allows the primary body to rotate independently with respect to the secondary body in a first rotational direction.

7. A device in accordance with claim 6, wherein the at least two tapering spaces taper towards one another; and wherein the displacement means is disposed between the at least two tapering spaces.

8. A device in accordance with claim 6, wherein the at least two tapering spaces taper away from one another; and wherein the displacement means is disposed on both sides of the at least two tapering spaces.

9. A device in accordance with claim 6, further comprising:

biasing means, disposed between the displacement means and either of the sets of bearings, for biasing the bearings towards the binding location.

10. A device in accordance with claim 1, wherein the tapering space formed between the primary and secondary bodies includes a larger section between two smaller sections; and wherein the larger and smaller bearings include the larger bearing disposed in the larger section of the tapering space, and two smaller bearings, each disposed in one of the two smaller sections of the tapering space.

11. A device in accordance with claim 1, wherein the tapering space includes a larger tapering space and two smaller tapering spaces on either side of the larger tapering space; and wherein the larger and smaller bearings include a larger bearing disposed in the larger tapering space, and two smaller bearings disposed in either of the smaller tapering spaces.

12. A device in accordance with claim 1, wherein the bearings are non-circular.

13. A device in accordance with claim 1, wherein each of the bearings has a protrusion, pivotally disposed in an indentation formed in either one of the primary or secondary walls.

14. A device in accordance with claim 1, further comprising:

a third bearing smaller than the larger and smaller bearings disposed between the larger and smaller bearings.

15. A bearing clutch device, comprising:

a) a primary body having a primary wall;

b) a secondary body, rotatably coupled to the primary body, having a secondary wall generally opposing the primary wall; and c) at least one tapering space, formed between the primary and secondary walls, having at least two different size tapering sections including a larger tapering section and a smaller tapering section;

d) at least one set of bearings, movably disposed in the at least one tapering space, having at least two different size bearings including a larger bearing and a smaller bearing movably disposed in the respective larger and smaller tapering sections, the larger and smaller bearings being movable between:

1) a binding location in which the larger and smaller bearings are movable towards the respective larger and smaller tapering spaces to bind between the primary and secondary walls; and 2) a free location in which the larger and smaller bearings are movable away from the respective larger and smaller tapering spaces.

16. A device in accordance with claim 15, further comprising:

displacement means for displacing the larger and smaller bearings from the binding location to the free location.

17. A device in accordance with claim 15, further comprising:

a) a pivot member, pivotally coupled to the primary body;

b) a swivel link, engaged by the pivot member and pivotally coupled to the secondary body; and c) a pusher member, pivotally disposed on the end of the swivel link, to engage and dislodge the set of bearings.

18. A device in accordance with claim 15, further comprising:

biasing means, disposed between the primary and secondary bodies, for biasing the larger and smaller bearings towards the respective larger and smaller tapering spaces, and towards the binding location.

19. A device in accordance with claim 15, further comprising:

a) at least two tapering spaces, formed between the primary and secondary walls, including first and second tapering spaces tapering in opposite directions, and each having at least two different size tapering sections including a larger tapering section and a smaller tapering section;

b) at least two sets of bearings, each set movably disposed in one of the at least two tapering spaces, including first and second sets of bearing disposed in the respective first and second tapering spaces, and each set having at least two different size bearings including a larger bearing and a smaller bearing movably disposed in the respective larger and smaller tapering sections, the first and second sets of bearings each being selectively movable between binding and free locations; and c) displacement means for selectively displacing one of the first and second sets of bearings from the binding location to the free location, to prevent the displaced set of bearings from binding, such that displacement of the first set of bearing from the first tapering space allows the primary body to rotate independently with respect to the secondary body in a second rotational direction, and such that displacement of the second set of bearings from the second tapering space allows the primary body to rotate independently with respect to the secondary body in a first rotational direction.

20. A device in accordance with claim 19, wherein the at least two tapering spaces taper towards one another; and wherein the displacement means is disposed between the at least two tapering spaces.

21. A device in accordance with claim 19, wherein the at least two tapering spaces taper away from one another; and wherein the displacement means is disposed on both sides of the at least two tapering spaces.

22. A device in accordance with claim 15, wherein the tapering space includes a larger tapering space and two smaller tapering spaces on either side of the larger tapering space; and wherein the larger and smaller bearings include a larger bearing disposed in the larger tapering space, and two smaller bearings disposed in either of the smaller tapering spaces.

23. A device in accordance with claim 15, wherein the bearings are non-circular.

24. A device in accordance with claim 15, wherein each of the bearings has a protrusion, pivotally disposed in an indentation formed in either one of the primary or secondary walls.

25. A bearing clutch device, comprising:

a) a secondary body rotatably coupled to a primary body forming a space therebetween; and b) at least one non-circular bearing, movably disposed in the space, and being movable between a free location and a binding location in which the bearing binds between the primary and secondary bodies.

26. A device in accordance with claim 25, wherein the bearing has a protrusion, pivotally disposed in an indentation formed in either one of the primary or secondary bodies, and being pivotable about the protrusion.

27. A device in accordance with claim 25, further comprising:

displacement means for displacing the bearing from the binding location to the free location.

28. A device in accordance with claim 25, further comprising:

biasing means, disposed between the primary, and secondary bodies, for biasing the bearing towards the binding location.

29. A device in accordance with claim 1, wherein both of the larger and smaller bearings each form two points of engagement between the primary and secondary bodies at the tapering space.

* * * * *